US010466619B2

(12) United States Patent
Koyama et al.

(10) Patent No.: US 10,466,619 B2
(45) Date of Patent: Nov. 5, 2019

(54) REPLACEABLE UNIT, DEVELOPING UNIT, IMAGE FORMING UNIT, AND IMAGE FORMING APPARATUS

(71) Applicant: Oki Data Corporation, Tokyo (JP)

(72) Inventors: Tetsu Koyama, Tokyo (JP); Junichi Ito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/924,752

(22) Filed: Mar. 19, 2018

(65) Prior Publication Data

US 2018/0275560 A1 Sep. 27, 2018

(30) Foreign Application Priority Data

Mar. 24, 2017 (JP) ..... 2017-059732

(51) Int. Cl.

| | |
|---|---|
| ***G03G 15/08*** | (2006.01) |
| ***G03G 21/12*** | (2006.01) |
| ***G03G 21/16*** | (2006.01) |
| ***G03G 21/18*** | (2006.01) |

(52) U.S. Cl.

CPC ..... *G03G 15/0863* (2013.01); *G03G 15/0865* (2013.01); *G03G 21/12* (2013.01); *G03G 21/1647* (2013.01); *G03G 21/1821* (2013.01); *G03G 21/1875* (2013.01); *G03G 21/1885* (2013.01)

(58) Field of Classification Search

None

See application file for complete search history.

(56) References Cited

U.S. PATENT DOCUMENTS

| | | | | |
|---|---|---|---|---|
| 4,281,918 | A | 8/1981 | Fortmann | |
| 2012/0200871 | A1* | 8/2012 | Takahashi | G03G 21/1652 358/1.9 |
| 2014/0212151 | A1 | 7/2014 | Oda | |

FOREIGN PATENT DOCUMENTS

| | | | |
|---|---|---|---|
| EP | 0639801 | A1 | 2/1995 |
| EP | 1923753 | A2 | 5/2008 |
| EP | 2703903 | A2 | 3/2014 |
| EP | 2762982 | A1 | 8/2014 |
| EP | 2980656 | A1 | 2/2016 |
| JP | S59126563 | A | 7/1984 |
| JP | 2010204353 | A | 9/2010 |
| JP | 2014149341 | A | 8/2014 |

OTHER PUBLICATIONS

Extended European Search Report dated Sep. 21, 2018 in EP Application No. 18161886.9.

* cited by examiner

*Primary Examiner* — Victor Verbitsky

(74) *Attorney, Agent, or Firm* — Panitch Schwarze Belisario & Nadel LLP

(57) ABSTRACT

A replaceable unit includes a body, a memory element, a holder, and a first post. The holder has a first hole and holds the memory element to the body. The first post is provided on the body, and includes a first insert and a first head. The first insert is inserted into the first hole. The first head is located on opposite side of the first insert to the body and covers a periphery of the first hole of the holder.

14 Claims, 11 Drawing Sheets

REPLACEABLE UNIT, DEVELOPING UNIT, IMAGE FORMING UNIT, AND IMAGE FORMING APPARATUS

CROSS REFERENCE TO RELATED APPLICATIONS

The present application claims priority from Japanese Patent Application No. 2017-059732 filed on Mar. 24, 2017, the entire contents of which are hereby incorporated by reference.

BACKGROUND

The technology relates to a replaceable unit, a developing unit, an image forming unit, and an image forming apparatus.

For example, Japanese Unexamined Patent Application Publication No. 2014-149341 (corresponding to US Patent Application Publication No. 2014/0212151 and European Patent Application Publication No. 2762982) filed by the applicant discloses a technique related to a replaceable unit and an image forming apparatus provided with the replaceable unit. The replaceable unit is, for example, a developer container having a memory and a frame. The memory serves as an installation detecting member and is held by the frame. The memory stores information related to a type of the replaceable unit, e.g., information regarding a color of a developer contained in the developer container. The memory is configured to perform communication between the memory and a communicator mounted on a body of the image forming apparatus, for example.

SUMMARY

A used developer container that has been detached, as a replaceable unit, from an image forming apparatus is collected. The collected replaceable unit is refilled with a new developer, and is delivered again as a recycled product. Therefore, it is preferred that distinction of such a replaceable unit between a new product and a recycled product is possible, for example, in view of quality control.

It is desirable to provide a replaceable unit that allows for making an easy determination as to whether the replaceable unit is a recycled product, a developing unit provided with the replaceable unit, an image forming unit provided with the replaceable unit, and an image forming apparatus provided with the replaceable unit.

According to one embodiment of the technology, there is provided a replaceable unit including a body, a memory element, a holder, and a first post. The holder has a first hole and holds the memory element to the body. The first post is provided on the body, and includes a first insert and a first head. The first insert is inserted into the first hole. The first head is located on opposite side of the first insert to the body and covers a periphery of the first hole of the holder.

DETAILED DESCRIPTION

Some example embodiments of the technology are described below in detail with reference to the accompanying drawings. It is to be noted that the description below refers to mere specific examples of the technology, and the technology is therefore not limited thereto. Further, the technology is not limited to factors such as arrangements, dimensions, and dimension ratios of components illustrated in the respective drawings. The elements in the following example embodiments which are not recited in a most-generic independent claim of the technology are optional and may be provided on an as-needed basis. The description is given in the following order.

1. First Example Embodiment (A Replaceable Unit Having a Lockout Post, and an Image Forming Apparatus Provided with the Replaceable Unit)

2. Second Example Embodiment (A Replaceable Unit Having a Groove on an Inner Surface of a Hole Into Which a Post is Inserted, and an Image Forming Apparatus Provided with the Replaceable Unit)

3. Modification Examples

[1. First Example Embodiment]

[Configuration of Image Forming Apparatus]

Figure 1:
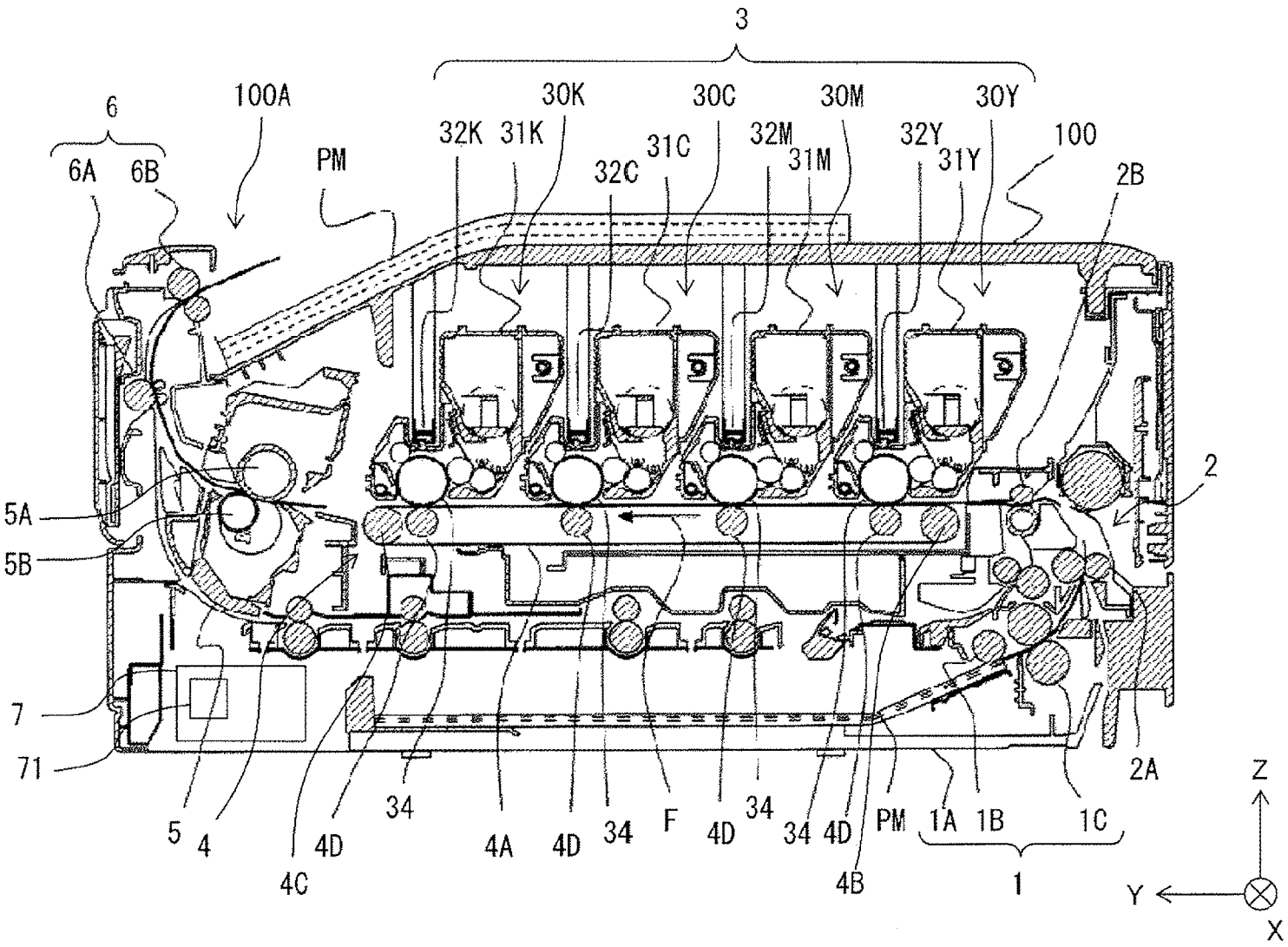
FIG. 1 is a schematic diagram illustrating an example of a general configuration of an image forming apparatus according to a first example embodiment of the technology.

FIG. 1 schematically illustrates an example of a general configuration of an image forming apparatus according to a first example embodiment of the technology. The image forming apparatus may correspond to an "image forming apparatus" in one specific but non-limiting embodiment of the technology. The image forming apparatus according to the first example embodiment may be a printer that forms, using an electrophotography scheme, an image such as a color image on a medium PM such as a sheet or a film that is to be subjected to printing, for example. The image forming apparatus may include, for example, inside a housing 100, a medium feeding section 1, a conveying section 2, an image forming section 3, a transfer section 4, a fixing section 5, a discharging section 6, and a controller 7. The controller 7 may control an operation of each of the medium feeding section 1, the conveying section 2, the image forming section 3, the transfer section 4, the fixing section 5, and the discharging section 6. Further, the controller 7 may include a communicator 71 built in the controller 7. The communicator 71 may perform transmission and reception of data with a memory element 21 that is attached to the image forming section 3 and will be described later.

It is to be noted that a path along which the medium PM is conveyed is referred to as a conveyance path herein. Regarding the conveyance path, a direction from any component toward the medium feeding section 1 or a position that is closer to the medium feeding section 1 than any component is referred to as "upstream" of the component. Regarding the conveyance path, a direction opposite to the direction from any component toward the medium feeding section 1 or a position that is away from the medium feeding section 1 than any component is referred to as "downstream" of the component. Regarding the conveyance path, a direction in which the medium PM travels, i.e., a direction from the upstream to the downstream, is referred to as a "conveyance direction F". A direction that is parallel to the medium PM conveyed along the conveyance path and is orthogonal to the conveyance direction F, e.g., an X-axis direction in FIG. 1, is referred to as a "width direction". A dimension in the conveyance direction F is referred to as a "length". A dimension in the width direction is referred to as a "width".

[Medium Feeding Section 1]

The medium feeding section 1 may feed the media PM to the conveying section 2 one by one. The medium feeding section 1 may include a cassette 1A, a pickup roller 1B, and a feeding roller 1C, for example. The cassette 1A may contain a plurality of media PM in a stacked state. The cassette 1A may be attached detachably at a lower part of the image forming apparatus, for example. The pickup roller 1B and the feeding roller 1C may cause the media PM contained in the cassette 1A to be sequentially fed out to the conveyance path that leads to the conveying section 2. The pickup roller 1B and the feeding roller 1C may each perform a rotation operation in a direction in which the medium PM is fed out toward the conveying section 2 that is located downstream of the pickup roller 1B and the feeding roller 1C. The pickup roller 1B and the feeding roller 1C may each perform the foregoing rotation operation on the basis of a control performed by the controller 7. The pickup roller 1B may be located at a position at which the pickup roller 1B is able to come into contact with an upper surface of the medium PM on the top. The feeding roller 1C may be located downstream of the pickup roller 1B.

[Conveying Section 2]

The conveying section 2 may convey the medium PM fed from the medium feeding section 1 toward the transfer section 4 while controlling a skew of the medium PM. The conveying section 2 may include, for example, two pairs of conveying rollers, i.e., a pair of conveying rollers 2A and a pair of conveying rollers 2B.

[Image Forming Section 3]

Figure 2:
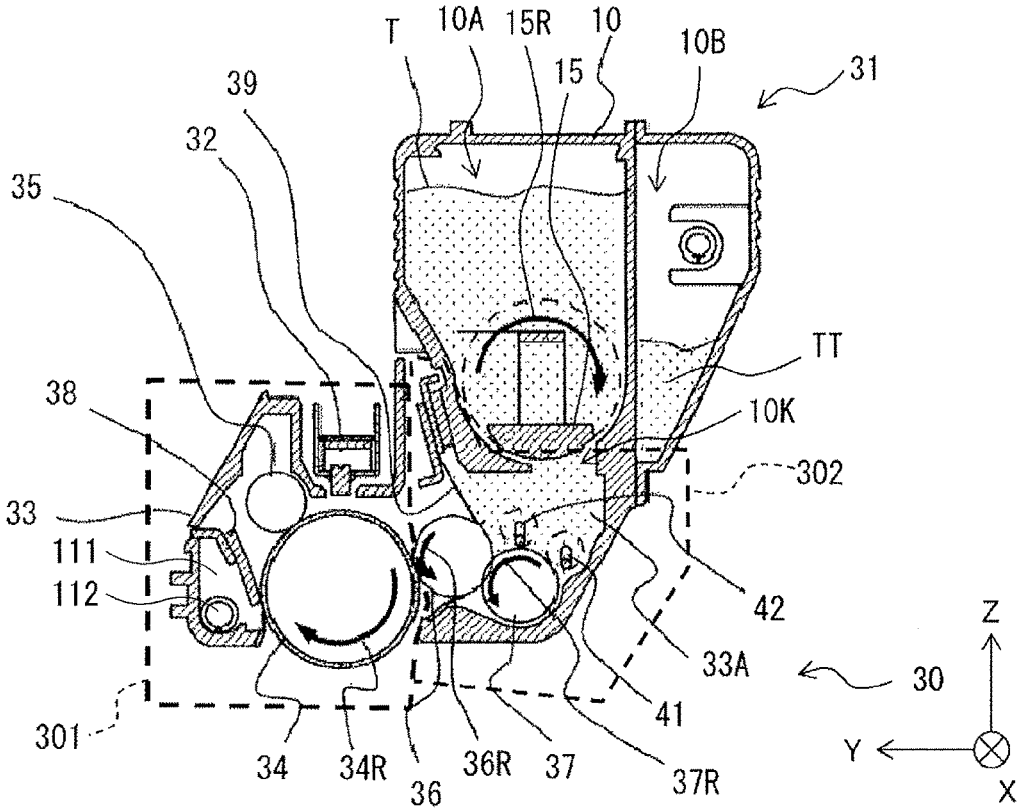
FIG. 2 is a schematic diagram illustrating an example of an internal configuration of an image forming section illustrated in FIG. 1.

The image forming section 3 may form a toner image on the medium PM conveyed from the conveying section 2, as illustrated in FIG. 2 which will be referred to later. The image forming section 3 may include four image forming units, i.e., image forming units 30Y, 30M, 30C and 30K, for example, as illustrated in FIG. 1. The image forming units 30Y, 30M, 30C, and 30K may form respective toner images (images) by the use of corresponding toners T. For example, the image forming units 30Y, 30M, 30C, and 30K may form respective toner images by the use of a yellow toner, a magenta toner, a cyan toner, and a black toner, respectively. The image forming units 30Y, 30M, 30C, and 30K may be disposed in this order from the upstream to the downstream in the conveyance direction F, for example. It is to be noted that, herein, the image forming units 30Y, 30M, 30C, and 30K may be collectively referred to as an image forming unit 30 when the four image forming units 30Y, 30M, 30C, and 30K are not distinguished from each other. The image forming section 3 may further include toner cartridges 31Y, 31M, 31C, and 31K corresponding to the image forming units 30Y, 30M, 30C, and 30K, respectively. Each of the toner cartridges 31Y, 31M, 31C, and 31K may serve as a developer container. The image forming section 3 may further include exposure devices 32Y, 32M, 32C, and 31K corresponding to the image forming units 30Y, 30M, 30C, and 30K, respectively. Herein, the four toner cartridges 31Y, 31M, 31C, and 31K may be collectively referred to as a "toner cartridge 31" in some cases. The four exposure devices 32Y, 32M, 32C, and 32K may be collectively referred to as an "exposure device 32" in some cases. It is to be noted that the toner cartridge 31 may be attachable to and detachable from the image forming unit 30; however, the toner cartridge 31 and the image forming unit 30 may be provided integrally in one example embodiment.

FIG. 2 is a schematic diagram illustrating an example of an internal configuration of the image forming section 3. The image forming unit 30 may include a drum unit 301 and a developing unit 302, as illustrated in FIG. 2. The drum unit 301 may include, inside a housing 33, a photosensitive drum 34 a charging roller 35, a cleaning blade 38, a waste toner collector 111, a waste toner conveying member 112, etc. The exposure device 32 may be so provided as to be able to perform exposure on the photosensitive drum 34 from outside of the housing 33. The exposure device 32 may include an exposure head. The exposure head may include a light-emitting diode (LED), etc., for example. The developing unit 302 may include, inside the housing 33 that is shared with the drum unit 301, a developing roller 36, a feeding roller 37, a doctor blade 39, i.e., a development blade, etc. The developing unit 302 may be provided integrally with the drum unit 301. The developing unit 302 may have, inside the housing 33, a containing chamber 33A that is temporarily stocked with the toner T fed from the toner cartridge 31. In one example, the containing chamber 33A may be provided with stirring members 41 and 42 that stir the toner T. The toner cartridge 31 may have a containing chamber 10A that contains the toner T. The containing chamber 10A may have a discharge opening 10K at a lower part of the containing chamber 10A. The discharge opening 10K may be directed to putting the toner T into the containing chamber 33A of the developing unit 302. The toner cartridge 31 will be described later in greater detail.

The photosensitive drum 34 may be a cylindrical member having a surface (a surficial part) that is able to support an electrostatic latent image. The photosensitive drum 34 may include a photoreceptor such as an organic photoreceptor. In one example, the photosensitive drum 34 may include an electrically-conductive supporting body and a photosensitive layer, i.e., a photoconductive layer, that covers an outer circumferential part (a surface) of the electrically-conductive supporting body. The electrically-conductive supporting body may include a metal pipe including aluminum, for example. The photoconductive layer may have a structure including an electric charge generation layer and an electric charge transfer layer that are stacked in order, for example. The photosensitive drum 34 may perform a rotation operation at a predetermined circumferential velocity in a direction in which the medium PM is conveyed in the conveyance direction F, on the basis of a control performed by the controller 7.

The charging roller 35 may electrically charge the surficial part, i.e., the photosensitive layer, of the photosensitive drum 34. In other words, the charging roller 35 may be a charging member. The charging roller 35 may be so disposed as to be in contact with a surface of the photosensitive drum 34. The charging roller 35 may include a metal shaft and an electrically-semiconductive rubber layer that covers an outer circumferential part (a surface) of the metal shaft, for example. Non-limiting examples of the electrically-semiconductive rubber layer may include an electrically-semiconductive epichlorohydrin rubber layer. The charging roller 35 may perform a rotation operation, for example, in a direction that is the same as the direction of the rotation operation of the photosensitive drum 34, on the basis of a control performed by the controller 7.

The developing roller 36 may have a surface supporting the toner T that develops the electrostatic latent image. The developing roller 36 may be so disposed as to be in contact with the surface (the circumferential surface) of the photosensitive drum 34. The developing roller 36 may include a metal shaft and an electrically-semiconductive urethane rubber layer that covers an outer circumferential part (a surface) of the metal shaft, for example. The developing roller 36 may perform a rotation operation at a predetermined circumferential velocity in a direction that is opposite to the direction of the rotation operation of the photosensitive drum 34, on the basis of a control performed by the controller 7.

The feeding roller 37 may feed the toner T to the developing roller 36. In other words, the feeding roller 37 may be a feeding member. The feeding roller 37 may be so disposed as to be in contact with a surface (a circumferential surface) of the developing roller 36. The feeding roller 37 may include a metal shaft and a foamed silicone rubber layer that covers an outer circumferential part (a surface) of the metal shaft, for example. The feeding roller 37 may perform a rotation operation in a direction that is opposite to the direction of the rotation operation of the developing roller 36, on the basis of a control performed by the controller 7.

The cleaning blade 38 may scrape the toner T remained on the surface of the photosensitive drum 34. The cleaning blade 38 may include a flexible rubber material, a flexible plastic material, or any suitable material, for example. The waste toner TT scraped by the cleaning blade 38 may be moved into the waste toner collector 111. The waste toner TT moved into the waste toner collector 111 may be discharged into a side frame 50 by the waste toner conveying member 112 provided in the waste toner collector 111. The side frame 50 may be described later in greater detail.

The doctor blade 39 may control an amount of the toner T attached to the surface of the developing roller 36.

The exposure device 32 may perform exposure on the surficial part (the photosensitive layer) of the photosensitive drum 34 from the outside of the housing 33, and thereby form an electrostatic latent image on the surficial part (the photosensitive layer) of the photosensitive drum 34. The exposure device 32 may include a plurality of light emitters for each of the photosensitive drums 34. The light emitters may be disposed side by side in the width direction. Each of the light emitters may include a light source that emits application light, and a lens array that performs imaging of the application light on the surface of the photosensitive drum 34, for example. The light source that emits the application light may be an LED, for example.

The image forming unit 30 may correspond to an "image forming unit" in one specific but non-limiting embodiment of the technology. The toner T may correspond to a "developer" in one specific but non-limiting embodiment of the technology. The toner cartridge 31 may correspond to a "replaceable unit" in one specific but non-limiting embodiment of the technology. The developing unit 302 may be a developing device that forms a developer image, e.g., a toner image, on the surface of the photosensitive drum 34. The developing unit 302 may correspond to a "developing unit" in one specific but non-limiting embodiment of the technology. It is to be noted that in an example case where the developing unit 302 and the toner cartridge 31 are provided integrally, the developing unit 302 and the toner cartridge 31 together may correspond to any of the "developing unit" and the "replaceable unit" in one specific but non-limiting embodiment of the technology.

[Transfer Section 4]

The transfer section 4 may be also called a transfer belt unit. The transfer section 4 may include a transfer belt 4A, a driving roller 4B, an idle roller 4C, and a transfer roller 4D, for example. The driving roller 4B may drive the transfer belt 4A. The idle roller 4C may be driven in accordance with the driving roller 4B. The transfer roller 4D may face the photosensitive drum 34 with the transfer belt 4A in between. Each of the driving roller 4B and the idle roller 4C may be a substantially-cylindrical member that is rotatable around a rotation axis extending in the width direction, i.e., the X-axis direction. The transfer section 4 may convey, in the conveyance direction F, the medium PM conveyed from the conveying section 2. Further, the transfer section 4 may sequentially transfer, onto the surface of the medium PM, the toner images formed by the respective image forming units 30Y, 30M, 30C, and 30K.

The transfer belt 4A may be an endless elastic belt including a resin material such as polyimide resin, for example. The transfer belt 4A may lie on the driving roller 4B and the idle roller 4C while being stretched. The driving roller 4B may be driven to rotate in a direction in which the medium PM is conveyed in the conveyance direction F, on the basis of a control performed by the controller 7. The driving roller 4B may thereby cause the transfer belt 4A to rotate circularly. The driving roller 4B may be disposed upstream of any of the image forming units 30Y, 30M, 30C, and 30K. The idle roller 4C may adjust tension on the transfer belt 4A by means of bias force given by a bias member. The idle roller 4C may rotate in a direction that is the same as the rotation direction of the driving roller 4B. The idle roller 4C may be disposed downstream of any of the image forming units 30Y, 30M, 30C, and 30K.

The transfer roller 4D may electrostatically transfer, onto the medium PM, the toner images formed by the respective image forming units 30Y, 30M, 30C, and 30K while conveying the medium PM in the conveyance direction F by rotating in a direction opposite to the rotation direction of the photosensitive drum 34. The transfer roller 4D may include a foamed electrically-semiconductive elastic rubber material, for example.

[Fixing Section 5]

The fixing section 5 may apply heat and pressure to the toner image transferred onto the medium PM that has passed through the transfer section 4, and thereby fix the toner image onto the medium PM. The fixing section 5 may include an upper roller 5A and a lower roller 5B, for example.

Each of the upper roller 5A and the lower roller 5B may include a heat source that is provided inside each of the upper roller 5A and the lower roller 5B. The heat source may be, for example, a heater such as a halogen lamp. Each of the upper roller 5A and the lower roller 5B may thereby serve as a heating roller that applies heat to the toner image on the medium PM. The upper roller 5A may perform a rotation operation in a direction in which the medium PM is conveyed in the conveyance direction F, on the basis of a control performed by the controller 7. The heat source inside each of the upper roller 5A and the lower roller 5B may receive a bias voltage controlled by the controller 7, and thereby control a surface temperature of the corresponding one of the upper roller 5A and the lower roller 5B. The lower roller 5B may so face the upper roller 5A that a pressure-contact is provided between the upper roller 5A and the lower roller 5B. The lower roller 5B may thereby serve as a pressure-applying roller that applies pressure to the toner image on the medium PM. In one example, the lower roller 5B may include a surface layer including an elastic material.

[Discharging Section 6]

The discharging section 6 may discharge, to the outside, the medium PM to which the toner image is fixed by the fixing section 5. The discharging section 6 may include a conveying roller 6A and a conveying roller 6B, for example. Each of the conveying rollers 6A and 6B may cause the medium PM to be discharged to the outside through the conveyance path and cause an external stacker 100A to be stocked with the discharged medium PM. Each of the conveying rollers 6A and 6B may perform a rotation operation in a direction in which the medium PM is conveyed in the conveyance direction F, on the basis of a control performed by the controller 7.

[Detailed Configuration of Toner Cartridge 31]

Figure 3:
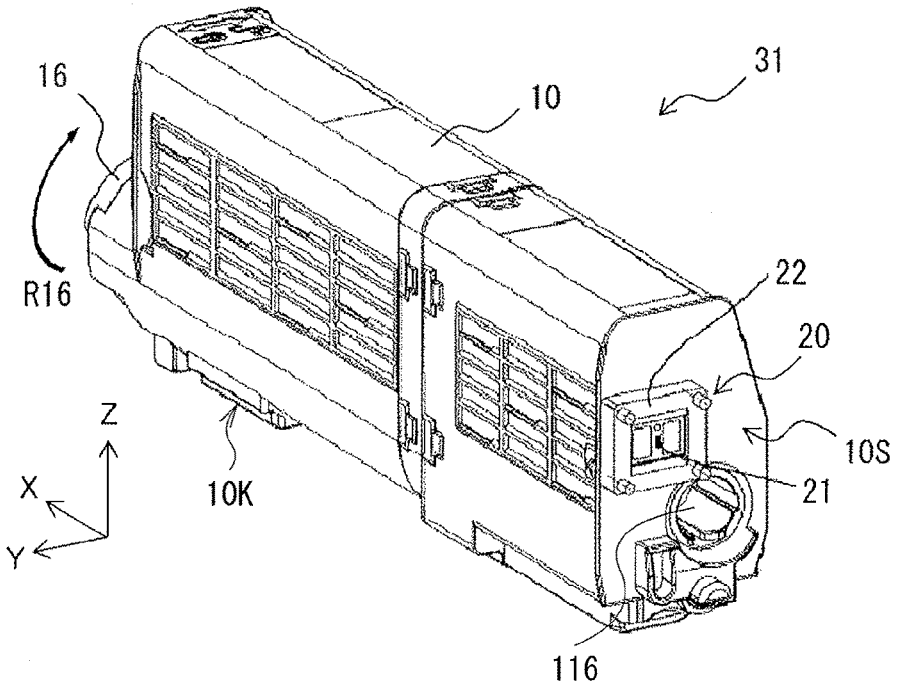
FIG. 3 is a perspective view of an example of an appearance of a toner cartridge illustrated in FIG 1.
Figure 4:
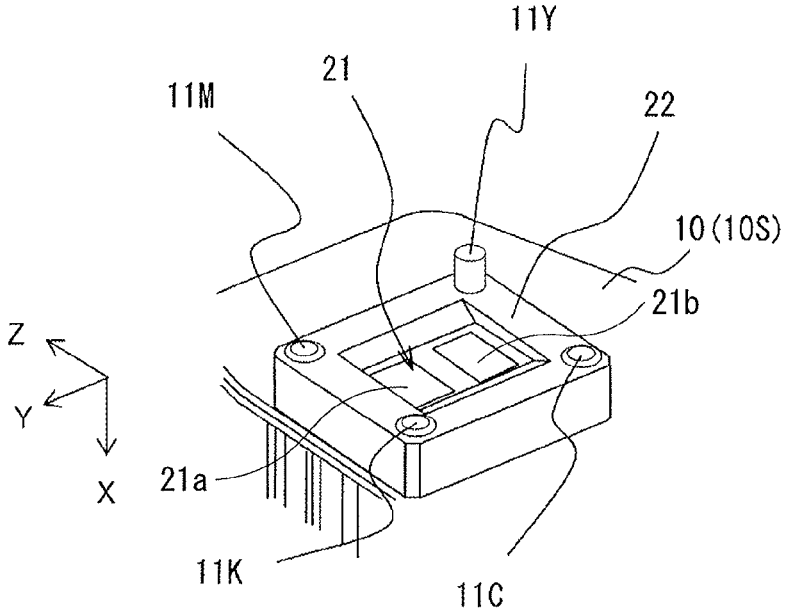
FIG. 4 is a perspective view illustrating, in an enlarged manner, an example of a memory device illustrated in FIG. 3.
Figure 5:
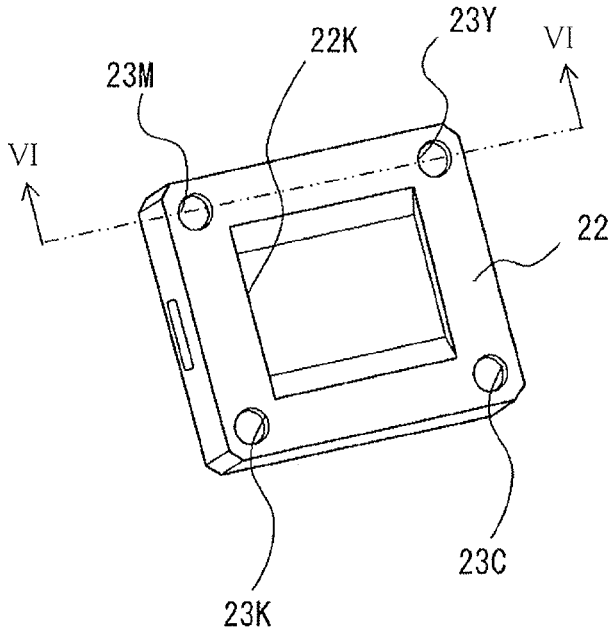
FIG. 5 is a perspective view illustrating, in an enlarged manner, an example of a cover of the memory device illustrated in FIG. 4.
Figure 6:
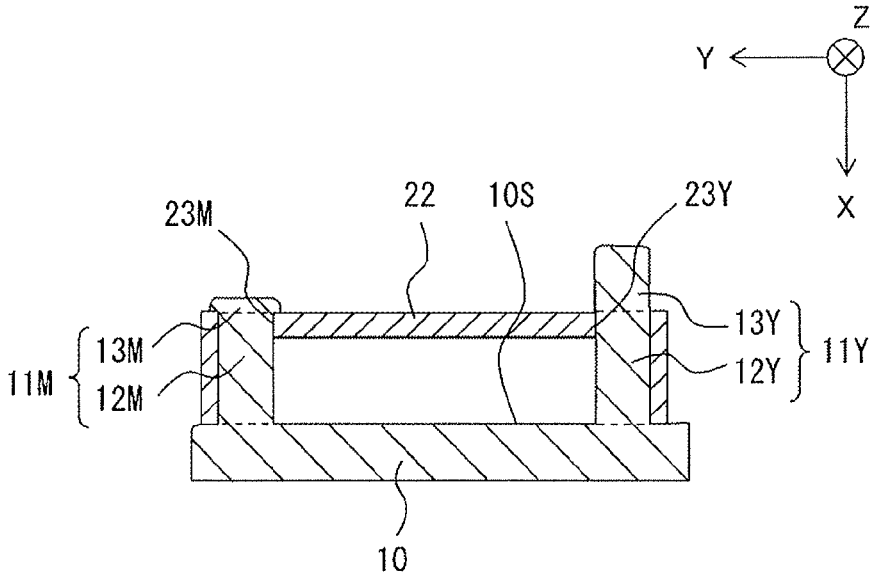
FIG. 6 is a cross-sectional view illustrating, in an enlarged manner, an example of a cross section of the memory device illustrated in FIG. 4.
Figure 7:
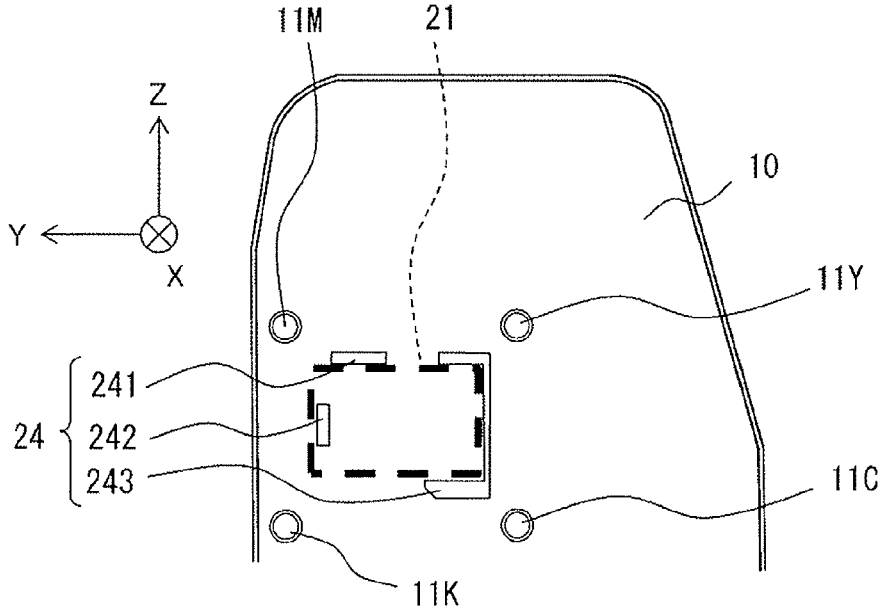
FIG. 7 is a front view illustrating, in an enlarged manner, an example of a front face of a body of the toner cartridge illustrated in FIG. 3.

A description is given below of a detailed configuration of the toner cartridge 31 with reference to FIGS. 3 to 7. FIG. 3 is a perspective view of an appearance of the toner cartridge 31. FIG. 4 is a perspective view illustrating, in an enlarged manner, a main part of the toner cartridge 31. FIG. 5 is a perspective view illustrating, in an enlarged manner, a cover 22 of a memory device 20. The cover 22 and the memory device 20 will be described later in greater detail. FIG. 6 is a cross-sectional view illustrating, in an enlarged manner, a cross section of the memory device 20. FIG. 7 is a front view illustrating, in an enlarged manner, a front face 10S of a body 10 of the toner cartridge 31. The front face 10S and the body 10 will be described later in greater detail.

The toner cartridge 31 may include the body 10, the memory device 20, and a lever 16. The memory device 20 may be provided on part of the body 10. In one example, the memory device 20 may be provided at one end of the body 10 in the X-axis direction. The lever 16 illustrated in FIG. 3 may be provided at the other end of the body 10 in the X-axis direction. The body 10 may have a hollow structure, and have the containing chamber 10A and a containing chamber 10B inside the body 10. The containing chamber 10A may contain the toner T before being used. The containing chamber 10B may contain a waste toner TT that has been already used and remains inside the image forming apparatus after image formation. The body 10 may correspond to a "body" in one specific but non-limiting embodiment of the technology. In one example, the body 10 of the toner cartridge 31Y may contain a yellow toner. The body 10 of the toner cartridge 31M may contain a magenta toner. The body 10 of the toner cartridge 31C may contain a cyan toner. The body 10 of the toner cartridge 31K may contain a black toner. It is to be noted that a description is given below referring to the toner cartridge 31Y containing the yellow toner, as an example.

The lever 16 may seal the toner T inside the body 10. The lever 16 may rotate in a direction indicated by an arrow R16 around the X axis as a rotation axis, to thereby cause a shutter 15 illustrated in FIG. 2 in the same direction. The lever 16 may thereby perform an open-close operation of the discharge opening 10K illustrated in FIG. 2.

The memory device 20 may include a memory element 21 and the cover 22, for example. The cover 22 may hold the memory element 21 to the body 10. The memory element 21 and the cover 22 may be provided separately from each other. The memory device 20 may correspond to a "memory device" in one specific but non-limiting embodiment of the technology. The memory element 21 may correspond to a "memory element" in one specific but non-limiting embodiment of the technology. The cover 22 may correspond to a "holder" in one specific but non-limiting embodiment of the technology.

The memory element 21 may be a contact-type (wired) random access read-only memory (ROM) that includes, for example, a semiconductor element as well as a first external terminal 21*a* and a second external terminal 21*b* both coupled to the semiconductor element. The memory element 21 may have a flat-plate-shaped appearance. The memory element 21 may store information such as the color of the toner T contained inside the body 10 or a remaining amount of the toner T contained inside the body 10. The first external terminal 21*a* and the second external terminal 21*b* of the memory element 21 may be configured to come into contact with a coupling terminal that is provided, for example, on the body 10 and is coupled to the communicator 71 of the controller 7. This may allow for transmission and reception of data between the memory element 21 and the communicator 71 of the controller 7. It is to be noted that the memory element 21 may be a wireless ROM that includes a semiconductor element and an antenna circuit, in one example. The first external terminal 21*a* and the second external terminal 21*b* may correspond to a "first terminal" and a "second terminal" in one specific but non-limiting embodiment of the technology, respectively.

As illustrated in FIG. 5, the cover 22 may be, for example, a frame member having an opening 22K in the middle of the cover 22 and having through holes 23, i.e., through holes 23Y, 23M, 23C, and 23K at respective four corners of the cover 22. It is to be noted, however, that the positions of the through holes 23 provided in the cover 22, the number of the through holes 23, a shape of an inner circumferential surface of each of the through holes 23, and a dimension of the inner circumferential surface of each of the through holes 23 are not limited to those illustrated in FIG. 5, and are modifiable as appropriate.

Each of the through holes 23Y, 23M, 23C, and 23K may be provided through the cover 22 in the X-axis direction in a state where the cover 22 is attached to the body 10. The through holes 23M, 23C, and 23K of the four through holes 23Y, 23M, 23C, and 23K may correspond to a "first hole" in one specific but non-limiting embodiment of the technology. The through hole 23Y of the four through holes 23Y, 23M, 23C, and 23K may correspond to a "second hole" in one specific but non-limiting embodiment of the technology.

Posts 11Y, 11M, 11C, and 11K may be provided on part of the body 10 at positions corresponding to the through holes 23Y, 23M, 23C, and 23K provided in the cover 22. For example, the posts 11Y, 11M, 11C, and 11K may be provided on the front face 10S of the body 10 at the positions corresponding to the through holes 23Y, 23M, 23C, and 23K provided in the cover 22. Each of the posts 11Y, 11M, 11C, and 11K may stand in the X-axis direction. The posts 11Y, 11M, 11C, and 11K may include inserts 12Y, 12M, 12C, and 12K and heads 13Y, 13M, 13C, and 13K, respectively. The inserts 12Y, 12M, 12C, and 12K may be inserted into the through holes 23Y, 23M, 23C, and 23K, respectively. The heads 13Y, 13M, 13C, and 13K may be located on opposite side of the inserts 12Y, 12M, 12C, and 12K to the front face 10S of the body 10 respectively. It is to be noted that the head 13M of the post 11M may be so expanded as to also cover a periphery of the through hole 23M of the cover 22, for example, as illustrated in FIG. 6. Each of the post 11C and the post 11K may have a structure similar to the foregoing structure of the post 11M. In contrast, the head 13Y of the post 11Y may not be so expanded as to also cover a periphery of the through hole 23Y of the cover 22. The head 13Y of the post 11Y may have a diameter that is substantially the same as a diameter of the insert 12Y as illustrated in FIG. 6. The head 13Y of the post 11Y may protrude toward side opposite to the body 10 by an amount that is greater than an amount by which each of the heads 13M, 13C, and 13K protrudes toward the side opposite to the body 10. Further, in one example, an outer circumferential surface of each of the inserts 12Y, 12M, 12C, and 12K may be in contact with an inner circumferential surface of corresponding one of the through holes 23Y, 23M, 23C, and 23K. One reason for this is that the cover 22 is held to the body 10 more firmly thereby, allowing the memory element 21 to be held to the body 10 firmly as a result. As described above, regarding the toner cartridge 31Y, the head 13Y of the post 11Y of the toner cartridge 31Y may protrude toward the side opposite to the front face 10S of the body 10 by an amount that is greater than an amount by which each of the heads 13M, 13C, and 13K protrudes toward the side opposite to the front face 10S of the body 10, as illustrated in FIG. 4. In contrast, regarding the toner cartridge 31M, the head 13M of the post 11M of the toner cartridge 31M may protrude toward the side opposite to the front face 10S of the body 10 by an amount that is greater than an amount by which each of the heads 13Y, 13C, and 13K protrudes toward the side opposite to the front face 10S of the body 10. Regarding the toner cartridge 31C, the head 13C of the post 11C of the toner cartridge 31C may protrude toward the side opposite to the front face 10S of the body 10 by an amount that is greater than an amount by which each of the heads 13Y, 13M, and 13K protrudes toward the side opposite to the front face 10S of the body 10. Regarding the toner cartridge 31K, the head 13K of the post 11K of the toner cartridge 31K may protrude toward the side opposite to the front face 10S of the body 10 by an amount that is greater than an amount by which each of the heads 13Y, 13M, and 13C protrudes toward the side opposite to the front face 10S of the body 10. Moreover, in one embodiment, an insertion direction in which each of the posts 11M, 11C and 11K is inserted into corresponding one of the through holes 23M, 23C, and 23K may be substantially coincident with an insertion direction in which the post 11Y is inserted into the through hole 23Y.

It is to be noted that the posts 11M, 11C, and 11K of the toner cartridge 31Y may correspond to a "first post" in one specific but non-limiting embodiment of the technology. The post 11Y of the toner cartridge 31Y may correspond to a "second post" in one specific but non-limiting embodiment of the technology. The inserts 12M, 12C, and 12K of the toner cartridge 31Y may correspond to a "first insert" in one specific but non-limiting embodiment of the technology. The insert 12Y of the toner cartridge 31Y may correspond to a "second insert" in one specific but non-limiting embodiment of the technology.

In one example, a distance from the first external terminal 21*a* to each of the posts 11M and 11K may be smaller than a distance from the first external terminal 21*a* to the post 11Y. A distance from the second external terminal 21*b* to each of the posts 11M and 11K may be greater than a distance from the second external terminal 21*b* to the post 11Y. Further, each of the posts 11C and 11K may be located at a lower position in the vertical direction, i.e., the Z-axis direction, than the first external terminal 21*a*. The post 11Y may be located at an upper position in the vertical direction, i.e., the Z-axis direction, than the second external terminal 21*b*. Each of the first external terminal 21*a* and the second external terminal 21*b* may have a shape having a dimension in the vertical direction, i.e., the Z-axis direction, that is greater than a dimension in a direction orthogonal to the vertical direction, i.e., the Y-axis direction. Further, each of the first external terminal 21*a* and the second external terminal 21*b* may have a shape having a dimension in a direction in which the toner T passes through the discharge opening 10K from which the unused toner T is discharged from the containing chamber 10A i.e., the Z-axis direction, that is greater than a dimension in the Y-axis direction.

A region, on the front face 10S of the body 10, surrounded by the four posts 11Y, 11M, 11C, and 11K may be provided with a rib 24 that so stands as to define a position of the memory element 21. The rib 24 may include a first part 241, a second part 242, and a third part 243, for example. The memory element 21 may be held to the body 10 by being covered by the cover 22 while supported by the rib 24. The front face 10S of the body 10 may further have a collect hole 116 that is in communication with the containing chamber 10B and into which a toner discharge opening 115 is to be fit, as illustrated in FIG. 3. The toner discharge opening 115 will be described later in greater detail.

[Detailed Configuration of Image Forming Unit 30]

Figure 8A:
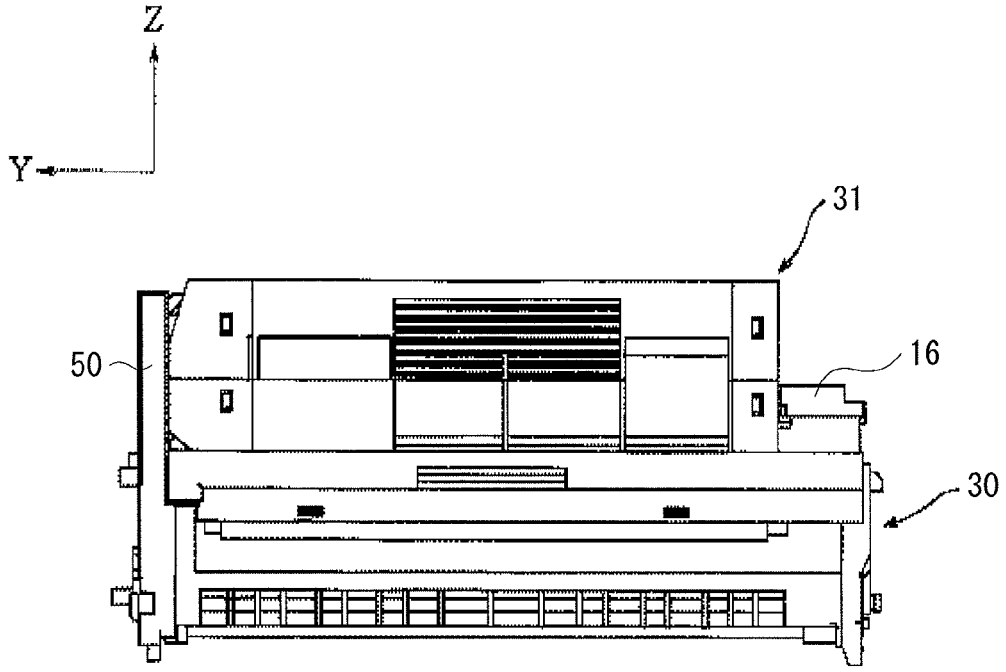
FIG. 8A is a rear view of an example of an appearance of the image forming section illustrated in FIG. 2.
Figure 8B:
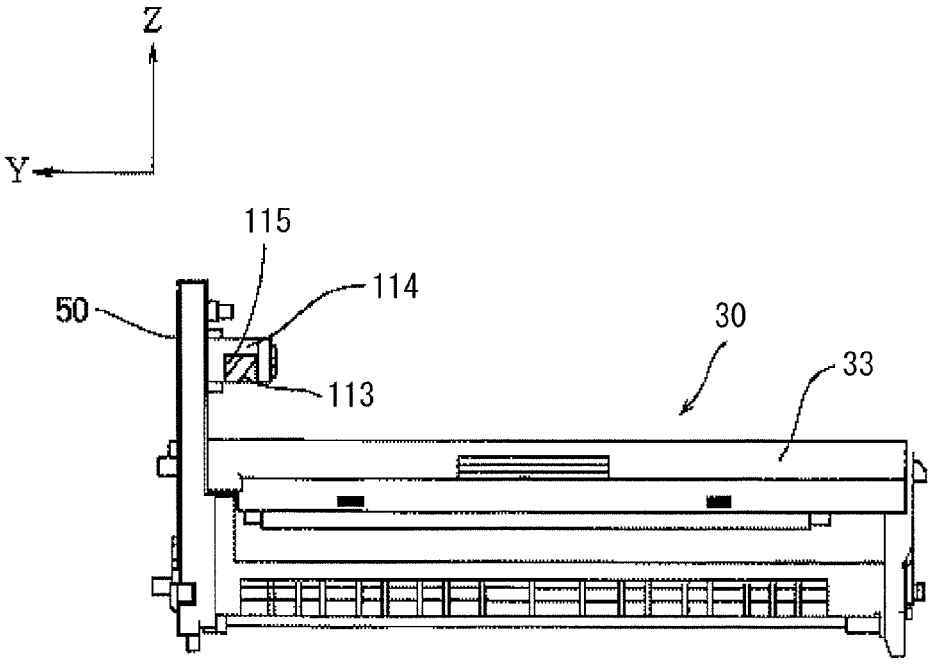
FIG. 8B is a rear view of an example of an appearance of an image forming unit of the image forming section illustrated in FIG. 2.

A further description is given below of the image forming unit 30, with reference to FIGS. 8A and 8B. FIG. 8A is a rear view of an appearance of the image forming section 3 illustrated in FIG. 2 viewed in the +Y direction. FIG. 8A illustrates a state where the toner cartridge 31 is attached to the image forming unit 30 and therefore the toner cartridge 31 and the image forming unit 30 are provided integrally with each other. FIG. 8B is a rear view of an appearance of the image forming unit 30 from which the toner cartridge 31 is detached, viewed in the +Y direction.

Figure 9:
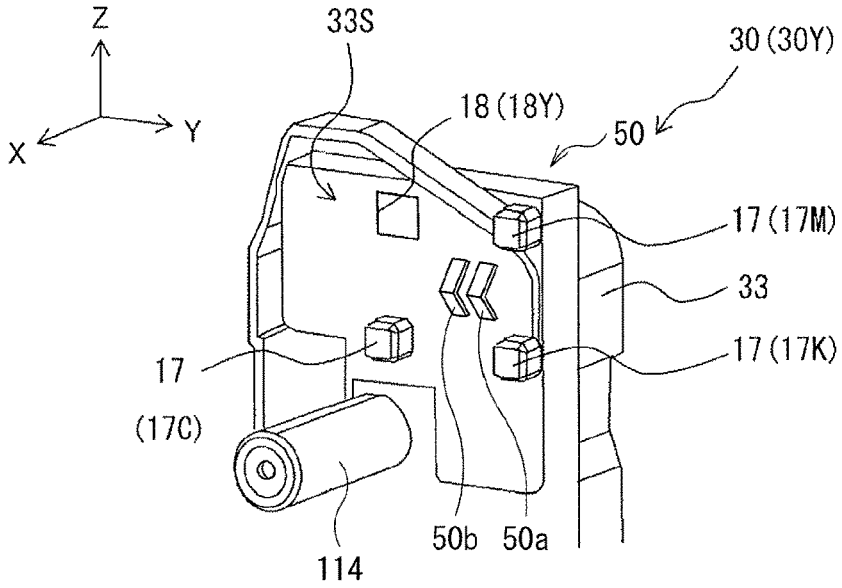
FIG. 9 is a perspective view illustrating, in an enlarged manner, an example of part of the image forming unit illustrated in FIG. 2.

As illustrated in FIGS. 8A and 8B, the side frame 50 may be provided at the end of the image forming unit 30 in the X-axis direction, i.e., at a position facing the memory device 20. FIG. 9 is a perspective view illustrating, in an enlarged manner, inner side of the side frame 50 of the image forming unit 30Y of the image forming units 30, i.e., a surface 33S of the image forming unit 30Y on side to which the toner cartridge 31Y is attached. The surface 33S of the side frame 50 may face the front face 10S of the body 10. The side frame 50 may receive the waste toner TT conveyed by the waste toner conveying member 112 illustrated in FIG. 2 provided inside the waste toner collector 111 illustrated in FIG. 2. The waste toner TT conveyed into the side frame 50 may be conveyed toward a discharge spiral 113 illustrated in FIG. 8B by a caterpillar-shaped collecting belt. The caterpillar-shaped collecting belt may be provided in the side frame 50. The discharge spiral 113 may be provided at an upper part of the side frame 50. The discharge spiral 113 may extend into a toner discharger 114 of the side frame 50. The toner discharger 114 may have a cylindrical shape that stands on the surface 33S facing the front face 105 of the toner cartridge 31, as illustrated FIG. 8B. Part of the toner discharger 114 may have the toner discharge opening 115 facing downward. This allows part of the discharge spiral 113 to be exposed outside from the toner discharge opening 115. In a state where the toner cartridge 31 is attached to the image forming unit 30 as illustrated in FIG. 8A, the toner discharger 114 may be fit into the collect hole 116 illustrated in FIG. 3 on the front face 10S of the body 10 of the toner cartridge 31. The toner discharger 114 may be thereby placed inside the containing chamber 10B for the waste toner TT. The waste toner TT may be moved into the containing chamber 10B from the toner discharge opening 115 in response to rotation of the discharge spiral 113 in a state where the toner discharger 114 is fit into the collect hole 116 of the toner cartridge 31.

Moreover, the surface 33S of the side frame 50 may be provided with a first electrode 50*a* and a second electrode 50*b* that are disposed at positions different from the position of the toner discharger 114. In a state where the toner cartridge 31 is attached to the image forming unit 30, the first electrode 50*a* may be in contact with the first external terminal 21*a* of the memory element 21, and the second electrode 50*b* may be in contact with the second external terminal 21*b* of the memory element 21. Each of the first electrode 50*a* and the second electrode 50*b* may include an electrically-conductive flexible member. Non-limiting examples of the electrically-conductive flexible member may include a plate-shaped spring and a spiral spring that both include a material including phosphor bronze or stainless steel.

[Method of Assembling Toner Cartridge 31]

Figure 10:
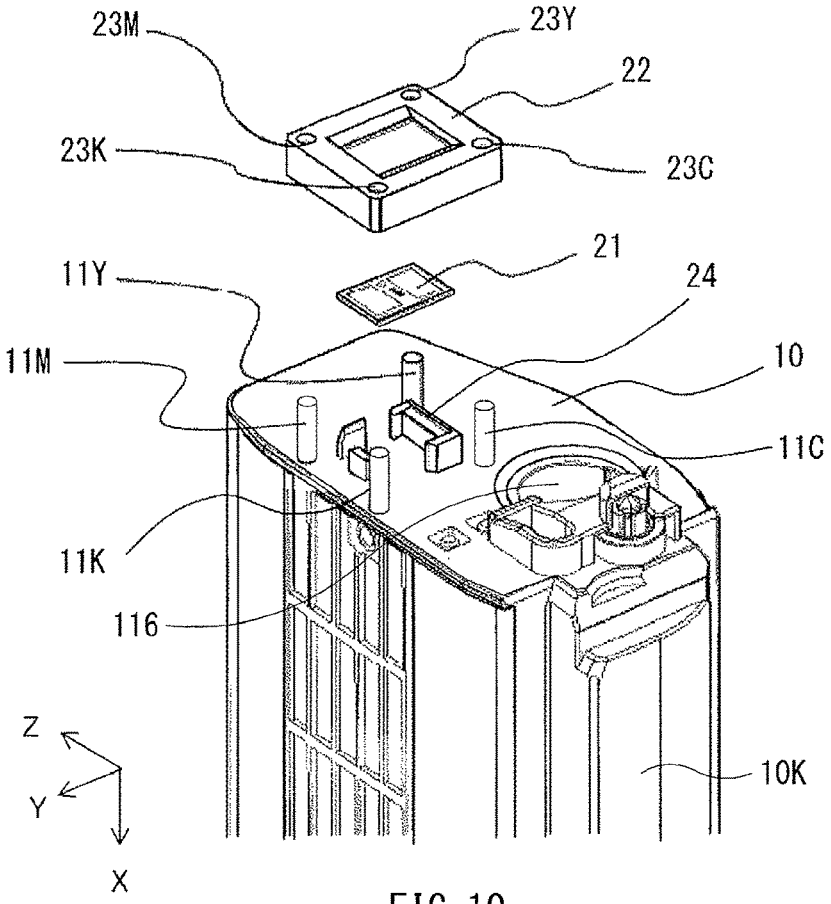
FIG. 10 is an exploded perspective diagram describing an example of an order to assemble the toner cartridge illustrated in FIG. 3.
Figure 11:
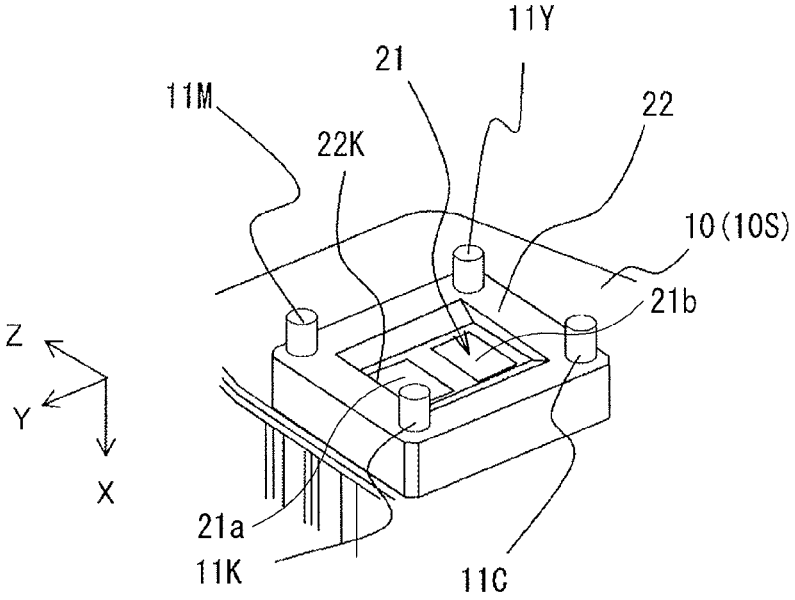
FIG. 11 is an exploded perspective diagram describing, in an enlarged manner, an example of the order to assemble the toner cartridge illustrated in FIG. 3.

A description is given next of a method of assembling the toner cartridge 31 with reference to FIGS. 10 and 11 together with FIGS. 3 to 9. A description is given below of a process of attaching the memory device 20 to the body 10. As illustrated in FIG. 10, first, the memory element 21 may be placed at the position defined by the rib 24. Thereafter, the cover 22 may be so disposed over the memory element 21 that the posts 11Y, 11M, 11C, and 11K are inserted into the through holes 23Y, 23M, 23C, and 23K, respectively. This may result in a state in which the heads 13Y, 13M, 13C, and 13K of the posts 11Y, 11M, 11C, and 11K protrude from the through holes 23Y, 23M, 23C, and 23K of the cover 22, respectively, as illustrated in FIG. 11. Further, the memory element 21 may be viewable through the opening 22K. Thereafter, the heads 13M, 13C, and 13K of the posts 11M, 11C, and 11K other than the head 13Y of the post 11Y may be heated to be thereby melted, for example. The heads 13M, 13C, and 13K may be thereby so expanded as to cover the peripheries of the through holes 23M, 23C, and 23K, respectively, as illustrated in FIG. 7, for example. The heads 13M, 13C, and 13K may be thus welded to the cover 22 by heat. As a result, the cover 22 may be fixed to the body 10 in a state where the head 13Y of the post 11Y protrudes toward the side opposite to the front face 10S of the body 10 by an amount that is greater than an amount by which each of the heads 13M, 13C, and 13K protrudes toward the side opposite to the front face 10S of the body 10, as illustrated in FIGS. 4 and 5. As will be described later, the post 11Y having the protruding head 13Y may serve as a lockout post that prevents the toner cartridge 31Y from being attached to any of the image forming units 30M, 30C, and 30K other than the image forming unit 30Y.

It is to be noted that the heads 13M, 13C and 13K may correspond to a "first head" in one specific but non-limiting embodiment of the technology. The head 13Y may correspond to a "second head" in one specific but non-limiting embodiment of the technology.

[Example Workings and Example Effects]

[A. Basic Operation]

The image forming apparatus may transfer the toner image onto the medium PM as follows.

A controller 7 of the image forming apparatus in operation may receive print image data and a printing order inputted from an external device such as a personal computer (PC). The controller 7 may cause a printing operation of the print image data to be started in response to the printing order.

For example, as illustrated in FIG. 1, the media PM contained in the cassette 1A may be picked up by the pickup roller 1B from the top. The picked-up medium PM may be fed by the feeding roller 1C toward the conveying section 2 located downstream while a skew of the medium PM is corrected by the feeding roller 1C. Thereafter, the medium PM may be conveyed toward the image forming section 3 by the two pairs of conveying rollers 2A and 2B. The toner image may be transferred onto the medium PM by the image forming section 3 as follows.

The image forming section 3 may form a toner image of each color by the following electrophotographic process on the basis of a printing order given by the controller 7. For example, the controller 7 may cause the toner T contained in the containing chamber 10A of the toner cartridge 31 to be put into the containing chamber 33A of the housing 33. The controller 7 may also cause the photosensitive drum 34 to rotate at a certain velocity in a predetermined direction. In accordance with the rotation of the photosensitive drum 34, each of the charging roller 35, the developing roller 36, and the feeding roller 37 may start the rotation operation in its predetermined direction.

Further, the controller 7 may apply a predetermined voltage to the charging roller 35 for each color, to thereby electrically charge the surface of the photosensitive drum 34 for each color uniformly. Thereafter, the controller 7 may activate the exposure device 32, and cause the exposure device 32 to apply, to the photosensitive drum 34 of each color, light corresponding to a color component of the print image based on an image signal. Thereby, an electrostatic latent image may be formed on the surface of the photosensitive drum 34 of each color.

The toner T may be fed to the developing roller 36 via the feeding roller 37. The fed toner T may be supported by the surface of the developing roller 36. The developing roller 36 may attach the toner T to the electrostatic latent image formed on the photosensitive drum 34 to thereby form the toner image. Further, the transfer roller 4D of the transfer section 4 may receive a predetermined voltage, leading to generation of an electric field between the photosensitive drum 34 and the transfer roller 4D. When the medium PM passes between the photosensitive drum 34 and the transfer roller 4D in such a state, the toner image formed on the photosensitive drum 34 may be transferred onto the medium PM.

Thereafter, the toner image on the medium PM may be applied with heat and pressure by the fixing section 5, to be thereby fixed onto the medium PM. Finally, the medium PM to which the toner image is fixed may be discharged, by the discharging section 6, into the stacker 100A outside the image forming apparatus.

[B. Regarding Prevention of Erroneous Attachment of Toner Cartridge 31]

A description is given below of a mechanism of the image forming apparatus according to the first example embodiment that prevents a user from attaching an improper toner cartridge 31 to the image forming unit other than the image forming unit 30 to which the toner cartridge 31 should be actually attached. In other words, the description is given of a mechanism that prevents erroneous attachment of the toner cartridge 31. In the first example embodiment, the image forming units 30Y, 30M, 30C, and 30K may have respective structures that are partially different from each other. For example, regarding the image forming unit 30Y, posts 17M, 17C, and 17K and a hole 18Y may be provided on the surface 33S, of the housing 33, that faces the front face 10S of the body 10 of the toner cartridge 31Y, as illustrated in FIG. 9. The hole 18Y may be located at a recessed position compared with a position of any of the posts 17M, 17C, and 17K, with respect to the front face 10S as a reference. It is to be noted that the surface 33S may correspond to an "attachment section" in one specific but non-limiting embodiment of the technology. The posts 17M, 17C, and 17K may correspond to a "first facing part" in one specific but non-limiting embodiment of the technology. The hole 18Y may correspond to a "second facing part" in one specific but non-limiting embodiment of the technology. In the toner cartridge 31Y, the cover 22 may be fixed to the body 10 in a state where the head 13Y of the post 11Y protrudes by an amount greater than an amount by which each of the heads 13M, 13C, and 13K protrudes, as described above. Accordingly, the attachment of the toner cartridge 31Y to the image forming unit 30Y may be achievable when the toner cartridge 31Y has an attitude with the head 13Y of the post 11Y facing the hole 18Y, the head 13M of the post 11M facing the post 17M, the head 13C of the post 11C facing the post 17C, and the head 13K of the post 11K facing the post 17K.

The image forming units 30Y, 30M, 30C, and 30K may differ from each other in an arrangement state of the posts 17 and the hole 18. For example, in the image forming unit 30M the hole 18 may be provided at a position, on the surface 33S, that faces the head 13M protruding by an amount greater than an amount by which each of the heads 13Y, 13C, and 13K protrudes. Further, the posts 17 may be provided at positions, on the surface 33S, that face the respective heads 13Y, 13C, and 13K. Similarly, in the image forming unit 30C, the hole 18 may be provided at a position, on the surface 33S, that faces the head 13C protruding by an amount greater than an amount by which each of the heads 13Y, 13M, and 13K protrudes. Further, the posts 17 may be provided at positions, on the surface 33S, that face the respective heads 13Y, 13M, and 13K. In the image forming unit 30K, the hole 18 may be provided at a position, on the surface 33S, that faces the head 13K protruding by an amount greater than an amount by which each of the heads 13Y, 13M, and 13C protrudes. Further, the posts 17 may be provided at positions, on the surface 33S, that face the respective heads 13Y, 13M, and 13C. Therefore, when an attempt is made to attach the toner cartridge 31Y to any of the image forming units 30M, 30C, and 30K, the protruding head 13Y of the post 11Y may cause interference with the post 17, which prevents the toner cartridge 31Y from being attached properly. For a similar reason, the toner cartridge 31M may be allowed to be attached to the image forming unit 30M, but may not be allowed to be attached to any of the image forming units 30Y, 30C, and 30K. The toner cartridge 31C may be allowed to be attached to the image forming unit 30C, but may not be allowed to be attached to any of the image forming units 30Y, 30M, and 30K. The toner cartridge 31K may be allowed to be attached to the image forming unit 30K, but may not be allowed to be attached to any of the image forming units 30Y, 30M, and 30C. Thus, each of the posts 11Y, 11M, 11C, and 11K of corresponding one of the toner cartridges 31Y, 31M, 31C, and 31K may serve as the lockout post, and thereby prevents erroneous attachment of the toner cartridge 31 to the improper image forming unit 30.

[C. Example Workings and Example Effects]

According to the first example embodiment of the technology, the toner cartridge 31, e.g., the toner cartridge 31Y, may include the body 10 and the memory device 20 having the memory element 21 and the cover 22. The cover 22 may hold the memory element 21 to the body 10. The cover 22 may have the through holes 23M, 23C, and 23K into which the inserts 12M, 12C, and 12K of the posts 11M, 11C, and 11K provided on the body 10 are inserted, respectively. The posts 11M, 11C, and 11K may include the heads 13M, 13C, and 13K that are located on the opposite side of the inserts 12M, 12C, and 12K to the body 10 and cover the peripheries of the through holes 23M, 23C, and 23M of the cover 22, respectively. In other words, the heads 13M, 13C, and 13K of the posts 11M, 11C, and 11K may be so expanded as to cover also the peripheries of the through holes 23M, 23C, and 23M of the cover 22. The cover 22 is therefore firmly attached to the body 10 while being sandwiched between the heads 13M, 13C and 13K and the body 10 without falling off from the posts 11M, 11C, and 11K. Accordingly, for example, an attempt to remove the cover 22 from the body 10 for replacement of the memory element 21 may lead to any of: deformation of the heads 13M, 13C, and 13K; falling-off of the heads 13M, 13C, and 13K from the inserts 12M, 12C, and 12K; and deformation of the through holes 23M, 23C, and 23M. Therefore, it is easy to determine that the toner cartridge 31, e.g., the toner cartridge 31Y, having any of the deformation of the heads 13M, 13C, and 13K, the falling-off of the heads 13M, 13C, and 13K from the inserts 12M, 12C, and 12K, and the deformation of the through holes 23M, 23C, and 23M is a recycled product. In contrast, it is easy to determine that the toner cartridge 31, e.g., the toner cartridge 31Y, having none of the deformation of the heads 13M, 13C, and 13K, the falling-off of the heads 13M, 13C, and 13K from the inserts 12M, 12C, and 12K, and the deformation of the through holes 23M, 23C, and 23M is a new product.

Hence, according to the toner cartridge 31 of the first example embodiment of the technology, and according to the developing unit 302, the image forming unit 30, and the image forming apparatus that are provided with the toner cartridge 31, easy distinction of the toner cartridge 31 between a new product and a recycled product is possible. This is favorable for appropriate quality control, etc.

In the first example embodiment of the technology, for example, the heads 13M, 13C, and 13K may be welded to the peripheries of the through holes 23M, 23C, and 23K, respectively. The cover 22 is therefore more firmly attached to the body 10 by means of the posts 11M, 11C, and 11K. As a result, it is possible to firmly hold the memory element 21 to the body 10.

Moreover, in one example of the first example embodiment, the outer circumferential surface of each of the inserts 12Y, 12M, 12C, and 12K may be in contact with the inner circumferential surface of the corresponding one of the through holes 23Y, 23M, 23C, and 23K. One reason for this is that the cover 22 is more firmly held to the body 10, which causes the memory element 21 to be firmly held to the body 10. Moreover, the insertion direction in which each of the posts 11M, 11C, and 11K is inserted into corresponding one of the through holes 23M, 23C, and 23K may be substantially coincident with the insertion direction in which the post 11Y is inserted into the through hole 23Y. This allows for easy attachment of the cover 22 to the body 10.

Moreover, in the first example embodiment, for example, the head 13Y of the post 11Y of the toner cartridge 31Y may not be so expanded as to cover the periphery of the through hole 23Y. Further, the head 13Y of the post 11Y of the toner cartridge 31Y may have a diameter that is substantially the same as the diameter of the insert 12Y. Further, the head 13Y of the post 11Y of the toner cartridge 31Y may protrude toward the side opposite to the body 10 by an amount that is greater than the amount by which each of the heads 13M, 13C, and 13K protrudes toward the side opposite to the body 10. This allows the toner cartridge 31Y to be attached only to the image forming unit 30Y that has a structure proper for the attachment of the toner cartridge 31Y. In other words, it is not possible to attach the toner cartridge 31Y to any of the image forming units 30M, 30C, and 30K. Hence it is possible to prevent erroneous attachment upon attachment of the toner cartridge 31 to the image forming unit 30.

[2. Second Example Embodiment]

[Detailed Configuration of Toner Cartridge 61]

Figure 12:
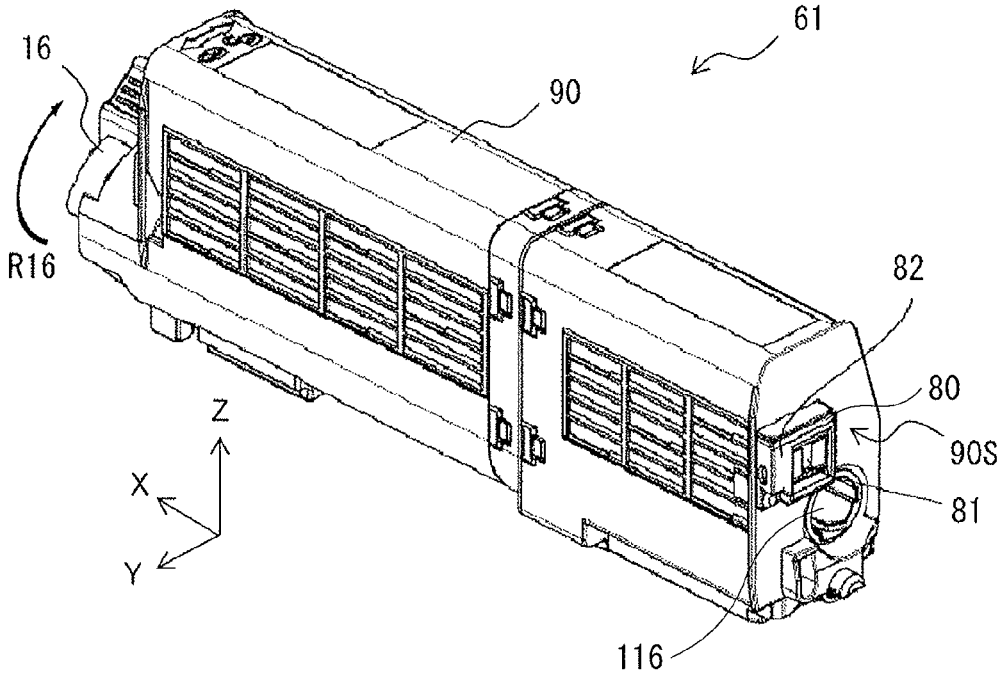
FIG. 12 is a perspective view of an example of an appearance of a toner cartridge according to a second example embodiment of the technology.
Figure 13:
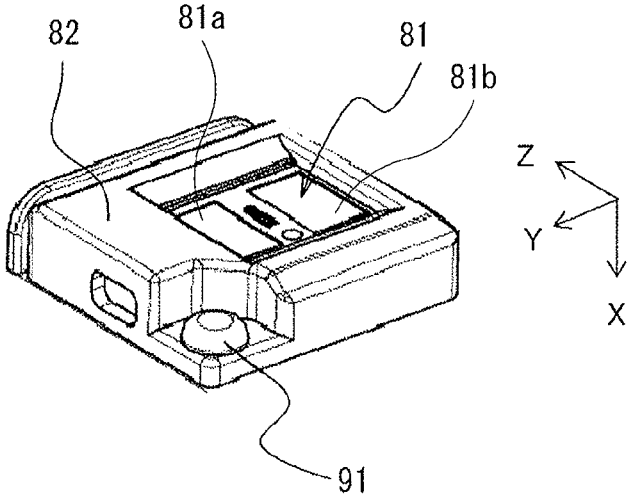
FIG. 13 is a perspective view illustrating, in an enlarged manner, an example of a memory device illustrated in FIG. 12.
Figure 14:
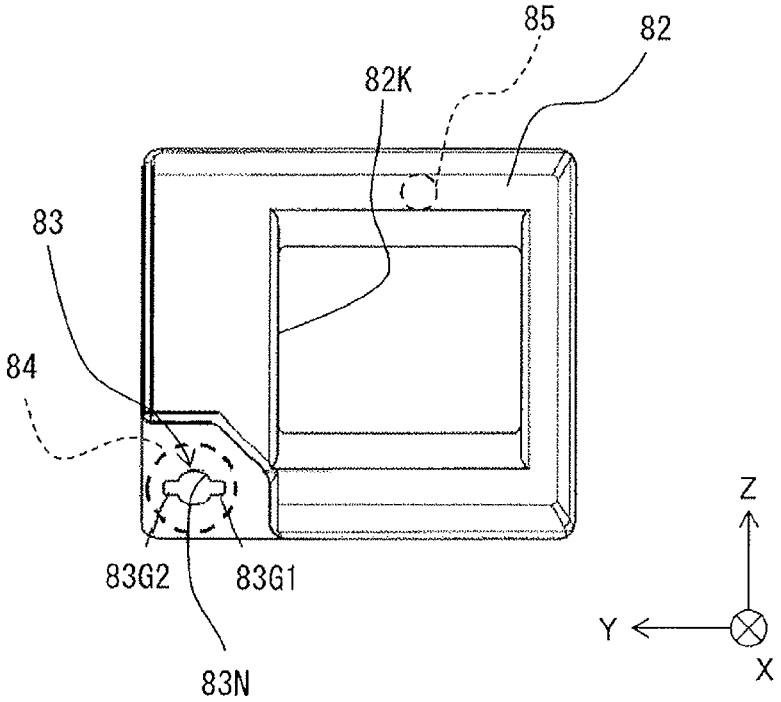
FIG. 14 is a perspective view illustrating, in an enlarged manner, an example of a cover of the memory device illustrated in FIG. 13.
Figure 15:
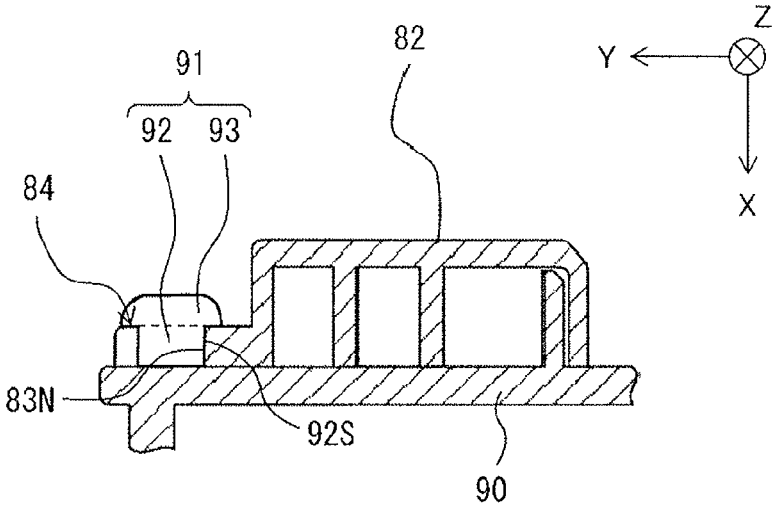
FIG. 15 is a cross-sectional view illustrating, in an enlarged manner, an example of a cross section of the memory device illustrated in FIG. 13.
Figure 16:
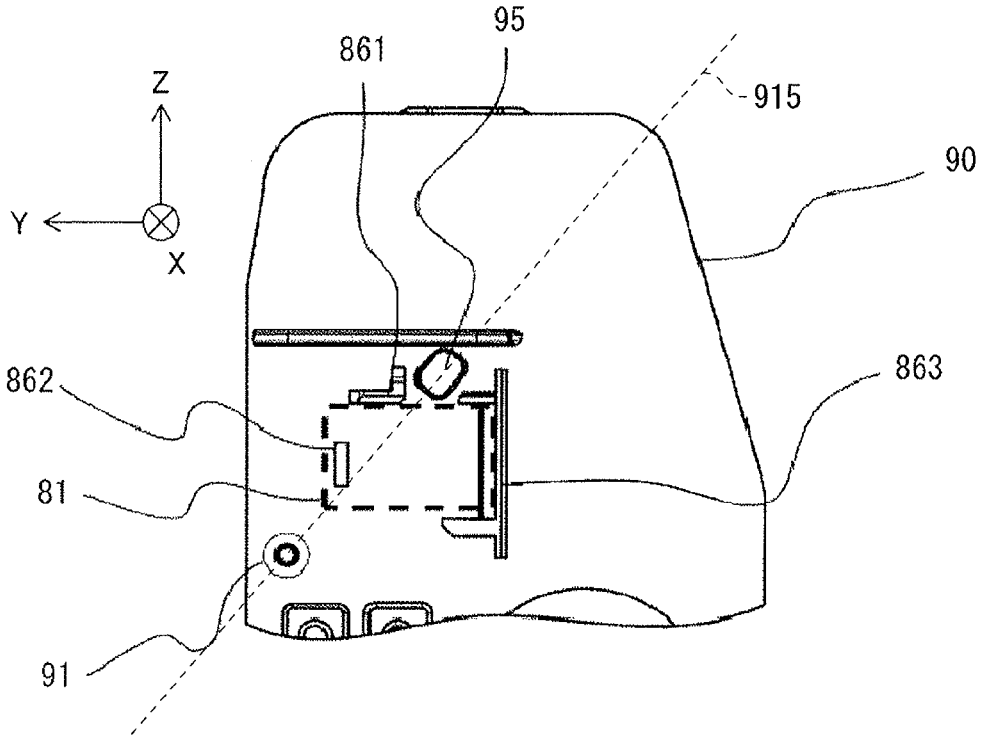
FIG. 16 is a front view illustrating, in an enlarged manner, an example of a front face of a body of the toner cartridge illustrated in FIG. 12.

A description is given below of a configuration of any of toner cartridges 61Y, 61M, 61C, and 61K according to a second example embodiment of the technology, with reference to FIGS. 12 to 16. The toner cartridges 61Y, 61M, 61C, and 61K may be hereinafter collectively referred to as a toner cartridge 61 in some cases. The toner cartridges 61Y, 61M, 61C, and 61K are applicable to the image forming apparatus according to the foregoing first example embodiment, and may correspond to the toner cartridges 31Y, 31M, 31C, and 31K, respectively. FIG. 12 is a perspective view of an appearance of the toner cartridge 61. FIG. 13 is a perspective view illustrating, in an enlarged manner, a main part of the toner cartridge 61. FIG. 14 is a perspective view illustrating, in an enlarged manner, a cover 82 of a memory device 80. The cover 82 and the memory device 80 will be described later in greater detail. FIG. 15 is a cross-sectional view illustrating, in an enlarged manner, a cross section of the memory device 80. FIG. 16 is a front view illustrating, in an enlarged manner, a front face 90S of a body 90 of the toner cartridge 61. The front face 90S and the body 90 will be described later in greater detail.

The toner cartridge 61 may include the body 90, the memory device 80, and the lever 16. The memory device 80 may be provided on part of the body 90. In one example, the memory device 80 may be provided at one end of the body 90 in the X-axis direction. The lever 16 may be provided at the other end of the body 90 in the X-axis direction. Except for the foregoing points, the toner cartridge 61 may have a configuration substantially the same as that of the toner cartridge 31 according to the foregoing first example embodiment. Therefore, the description given below refers to points that are substantially different from the toner cartridge 31 according to the foregoing first example embodiment, and does not refer to other points where appropriate.

The body 90 may have a hollow structure, and contain the toner inside the body 90. The body 90 may correspond to the "body" in one specific but non-limiting embodiment of the technology.

The memory device 80 may include a memory element 81 and the cover 82, for example. The cover 82 may hold the memory element 81 to the body 90. The memory element 81 and the cover 82 may be provided separately from each other. The memory device 80 may correspond to the "memory device" in one specific but non-limiting embodiment of the technology. The memory element 81 may correspond to the "memory element" in one specific but non-limiting embodiment of the technology. The cover 82 may correspond to the "holder" in one specific but non-limiting embodiment of the technology.

The memory element 81 may be a contact-type (wired) ROM that includes, for example, a semiconductor element as well as a first external terminal 81*a* and a second external terminal 81*b* both coupled to the semiconductor element. The memory element 81 may have a flat-plate-shaped appearance. The memory element 81 may store information such as the color of the toner contained inside the body 90 or a remaining amount of the toner contained inside the body 90. The first external terminal 81*a* and the second external terminal 81*b* of the memory element 81 may be configured to come into contact with a coupling terminal that is provided, for example, on the body 90 and is coupled to the communicator 71 of the controller 7. This may allow for transmission and reception of data between the memory element 81 and the communicator 71 of the controller 7. It is to be noted that the memory element 81 may be a wireless ROM that includes a semiconductor element and an antenna circuit, in one example. The first external terminal 81*a* and the second external terminal 81*b* may correspond to the "first terminal" and the "second terminal" in one specific but non-limiting embodiment of the technology, respectively.

As illustrated in FIG. 14, the cover 82 may be, for example, a frame member having an opening 82K in the middle of the cover 82 and have a through hole 83 at one of the four corners of the cover 82. The through hole 83 may have an inner circumferential surface 83N. The inner circumferential surface 83N may have, for example, grooves at two locations, i.e., a groove 83G1 and a groove 83G2. It is to be noted, however, that the position of the through hole 83 provided in the cover 82, the number of the through hole 83, the number of the grooves 83G1 and 83G2, a shape of the grooves 83G1 and 83G2, a shape of the inner circumferential surface 83N, and a dimension of the inner circumferential surface 83N are not limited to those illustrated in FIG. 14, and are modifiable as appropriate. The through hole 83 may be provided through the cover 82 in the X-axis direction in a state where the cover 82 is attached to the body 90. The through hole 83 may correspond to the "first hole" in one specific but non-limiting embodiment of the technology.

As illustrated in FIG. 15, the insert 92 may have an outer circumferential surface 92S. In one example, the outer circumferential surface 92S may be in contact with the inner circumferential surface 83N of the through hole 83. In one example, each of the grooves 83G1 and 83G2 may be filled with the insert 92.

Part of the body 90, e.g., the front face 90S of the body 90, may be provided with a post 91. The post 91 may be provided on part of the body 90, e.g., on the front face 90S of the body 90, at a position corresponding to the through hole 83 provided in the cover 82. The post 91 may stand in the X-axis direction. The post 91 may include an insert 92 and a head 93. The insert 92 may be inserted into the through hole 83. The head 93 may be located on opposite side of the insert 92 to the front face 90S of the body 90. The head 93 of the post 91 may be so expanded as to also cover a periphery 84 of the through hole 83 of the cover 82, for example, as illustrated in FIGS. 14 and 15.

The body 90 may further have a through hole 95, for example, on the front face 90S as illustrated in FIG. 16. The cover 82 may further include a post 85 that is inserted into the through hole 95 as illustrated in FIG. 14. In one example, the through hole 95 may extend along a straight line 915 that passes through the post 91 and the through hole 95. One reason for this is that this secures an adjustment margin directed to position adjustment between the body 90 and the cover 82 upon attachment of the cover 82 to the body 90. The through hole 95 may correspond to a "third hole" in one specific but non-limiting embodiment of the technology. The post 85 may correspond to a "third post" in one specific but non-limiting embodiment of the technology.

A region, on the front face 90S of the body 90, near the post 91 may be provided with ribs 861, 862, and 863 that so stand as to define a position of the memory element 81. The memory element 81 may be held to the body 90 by being covered with the cover 82 while being supported by the ribs 861 to 863.

It is to be noted that the toner cartridge 61 of the second example embodiment may be also attached to the image forming unit 30 to thereby form the image forming section as in the foregoing first example embodiment. In a state where the toner cartridge 61 is attached to the image forming unit 30, the first electrode 50*a* may be in contact with the first external terminal 81*a* of the memory element 81, and the second electrode 50*b* may be in contact with the second external terminal 81*b* of the memory element 81.

[Method of Assembling Toner Cartridge 61]

Figure 17:
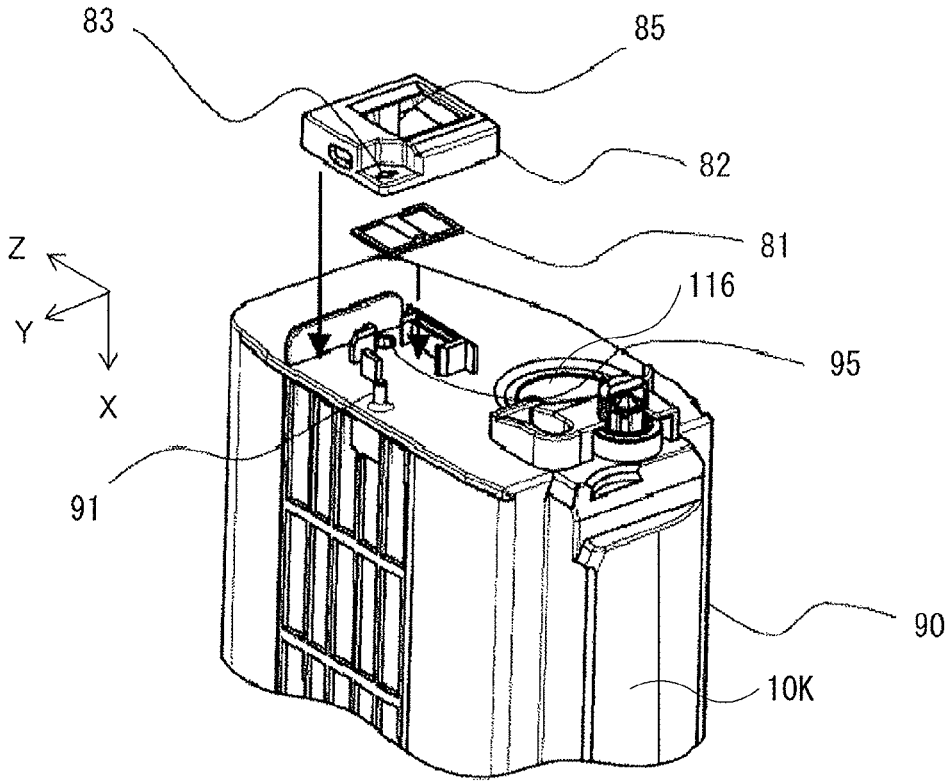
FIG. 17 is an exploded perspective diagram describing an example of an order to assemble the toner cartridge illustrated in FIG. 12.
Figure 18:
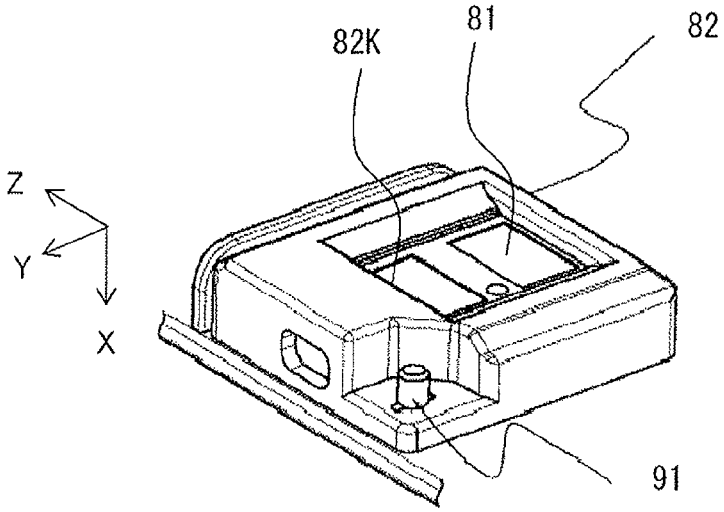
FIG. 18 is a perspective diagram describing, in an enlarged manner, an example of the order to assemble the toner cartridge illustrated in FIG. 12.
Figure 19:
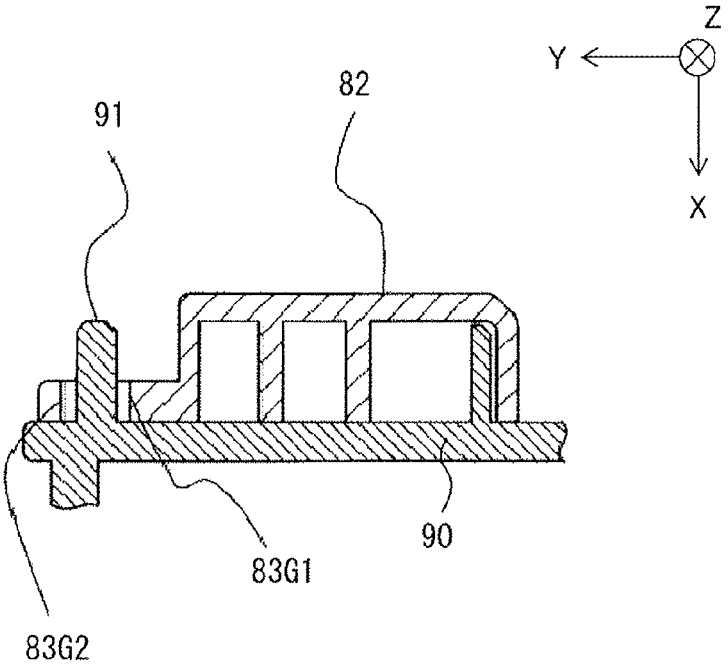
FIG. 19 is a cross-sectional view describing, in an enlarged manner, an example of one process in assembling the toner cartridge illustrated in FIG. 12.

A description is given next of a method of assembling the toner cartridge 61 with reference to FIGS. 17 to 19 together with FIGS. 12 to 16. A description is given below of a process of attaching the memory device 80 to the body 90. As illustrated in FIG. 17, first, the memory element 81 may be placed at the position defined by the ribs 861 to 863. Thereafter, the cover 82 may be so disposed over the memory element 81 that the posts 91 and 85 are inserted into the through holes 83 and 95, respectively. This may result in a state in which the head 93 of the post 91 protrudes from the through hole 83 of the cover 82, as illustrated in FIGS. 18 and 19. Further, the memory element 81 may be viewable through the opening 82K. Thereafter, the post 91 may be heated to be thereby melted, for example. This may lead to formation of the head 93 that is so expanded as to cover the periphery 84 of the through hole 83, as illustrated in FIG. 15, for example. On this occasion, the melted post 91 may flow into each of the grooves 83G1 and 83G2. This may bring the outer circumferential surface 92S of the insert 92 into contact with the inner circumferential surface 83N of the through hole 83. This may also fill each of the grooves 83G1 and 83G2 with the insert 92. The head 93 may be thus welded to the cover 82 by heat. As a result, the cover 82 may be fixed to the body 90.

[Example Workings and Example Effects]

According to the second example embodiment of the technology, the toner cartridge 61 may include the body 90, the memory device 80 having the memory element 81 and the cover 82. The cover 82 may hold the memory element 81 to the body 90. The cover 82 may have the through hole 83 into which the insert 92 of the post 91 provided on the body 90 is inserted. The post 91 may include the head 93 that is located on the opposite side of the insert 92 to the body 90 and covers the periphery 84 of the through hole 83 of the cover 82. In other words, the head 93 of the post 91 may be so expanded as to cover also the periphery 84 of the through hole 83 of the cover 82. The cover 82 is therefore firmly attached to the body 90 while being sandwiched between the head 93 and the body 90 without falling off from the post 91. Accordingly, for example, an attempt to remove the cover 82 from the body 90 for replacement of the memory element 81 may lead to any of: deformation of the head 93; falling-off of the head 93 from the insert 92; and deformation of the through hole 83. Therefore, it is easy to determine that the toner cartridge 61 having any of the deformation of the head 93, the falling-off of the head 93 from the insert 92, and the deformation of the through hole 83 is a recycled product. In contrast, it is easy to determine that the toner cartridge 61 having none of the deformation of the head 93, the falling-off of the head 93 from the insert 92, and the deformation of the through hole 83 is a new product.

Hence, according to the toner cartridge 61 of the second example embodiment of the technology, and according to the developing unit 302, the image forming unit 30, and the image forming apparatus that are provided with the toner cartridge 61, easy distinction of the toner cartridge 61 between a new product and a recycled product is possible. This is favorable for appropriate quality control, etc.

In one example of the second example embodiment, part of the inner circumferential surface 83N of the through hole 83 may have the grooves 83G1 and 83G2, and each of the grooves 83G1 and 83G2 may be also filled with the insert 92. This makes it possible to more firmly attach the cover 82 to the body 90 by means of the post 91. As a result, it is possible to firmly hold the memory element 81 to the body 90.

[3. Modification Examples]

The technology has been described above referring to some example embodiments. However, the technology is not limited to the example embodiments described above, and is modifiable in various ways. For example, the foregoing example embodiments have been described referring to the image forming apparatus that forms a color image; however, the technology is not limited thereto. In one alternative example embodiment, the technology is applicable to an image forming apparatus that forms a monochrome image by transferring, for example, only the black toner. Moreover, the foregoing example embodiments have been described referring to the image forming apparatus of a primary transfer scheme, i.e., a direct transfer scheme; however, the technology is not limited thereto. In one alternative example embodiment, the technology is applicable to an image forming apparatus of a secondary transfer scheme.

Moreover, the foregoing example embodiments have been described referring to an example in which each of the cover and the memory element has a substantially-rectangular shape; however, the shape of each of the cover and the memory element according to one embodiment of the technology is not limited thereto. In one alternative example embodiment, each of the cover and the memory element may have any shape.

Moreover, the foregoing example embodiments have been described referring to an example in which the LED head including a light-emitting diode as its light source is used as the exposure device; however, the technology is not limited thereto. In one alternative example embodiment, an exposure device including a laser element, etc. as its light source may be used.

Moreover, the foregoing example embodiments have been described referring to the image forming apparatus having a printing function as an example corresponding to the "image forming apparatus" according to one specific but non-limiting embodiment of the technology; however, the technology is not limited thereto. For example, the technology is also applicable to an image forming apparatus that serves as a multi-function peripheral having functions such as a scanner function or a facsimile function in addition to the foregoing printing function.

Moreover, the foregoing example embodiments have been described referring, as an example, to the image forming apparatus in which the memory element and the holder are both attached to the frame of the toner cartridge of the "developing unit"; however, the technology is not limited thereto. In one alternative example embodiment, the memory element and the holder may both be attached to an outer surface of the housing 33, for example. In another alternative example embodiment, the memory element and the holder may both be attached not to the "developing unit" but to a "drum unit". In this case, for example, the post directed to the attachment of both the memory element and the holder may be provided on the housing 33. In still another alternative example embodiment, the memory element and the holder may both be attached to each of the "developing unit" and the "drum unit". In this case, for example, the drum unit 301 including the photosensitive drum 34 may possibly correspond to the "replaceable unit" in one specific but non-limiting embodiment of the technology.

Moreover, the foregoing example embodiments have been described referring to an example in which the posts 11 and 91 are provided on the body 10 and 90, respectively, and the through holes 23 and 83 are provided in the covers 22 and 82, respectively; however, the technology is not limited thereto. In one alternative example embodiment, each of the first post and the second post may be provided on the holder, and the first hole and the second hole may both be provided in the body.

Moreover, the foregoing example embodiments have been described referring to an example in which the memory elements 21 and 81 are separately provided from the covers 22 and 82, respectively; however, the technology is not limited thereto. In one alternative example embodiment, the memory element and the holder may be provided integrally with each other.

Moreover, the foregoing second example embodiment has been described referring to an example in which the through hole 95 as the third hole is provided in the body 90, and the post 85 as the third post is provided on the cover 82; however, the technology is not limited thereto. In one alternative example embodiment, the third hole may be provided in the holder, and the third post may be provided on the body.

It is possible to achieve at least the following configurations from the above-described example embodiments of the technology.

(1)
A replaceable unit including:
a body;
a memory element;
a holder having a first hole and holding the memory element to the body; and
a first post provided on the body, and including a first insert and a first head, the first insert being inserted into the first hole, the first head being located on opposite side of the first insert to the body and covering a periphery of the first hole of the holder.

(2)
The replaceable unit according to (2), further including
a second post provided on the body, and including a second insert and a second head, the second head being located on opposite side of the second insert to the body and protruding by an amount greater than an amount by which the first head of the first post protrudes, in which
the holder further has a second hole, and
the second insert is inserted into the second hole.

(3)
The replaceable unit according to (2), in which a first insertion direction is substantially coincident with a second insertion direction, the first insertion direction being a direction in which the first post is inserted into the first hole, the second insertion direction being a direction in which the second post is inserted into the second hole.

(4)
The replaceable unit according to any one of (1) to (3), in which
the first hole has an inner circumferential surface, and
the first insert has an outer circumferential surface that is in contact with the inner circumferential surface of the first hole.

(5)
The replaceable unit according to (4), in which
the inner circumferential surface has a groove, and
the groove is filled with the first insert.

(6)
The replaceable unit according to any one of (1) to (5), in which the memory element and the holder are provided separately from each other.

(7)
The replaceable unit according to (1), further including
a third post provided on one of the body and the holder, in which
the other of the body and the holder has a third hole,
the third post is inserted into the third hole, and
the third hole extends along a straight line that passes through both the first post and the third hole.

(8)
A developing unit, including the replaceable unit according to any one of (1) to (7).

(9)
A developing unit including:
the replaceable unit according to (2) or (3); and
an attachment section to which the replaceable unit is to be attached,
the attachment section including
a first facing part provided at a first position, the first position facing the first post, and
a second facing part provided at a second position, the second position facing the second post, and being recessed, compared with the first position of the first facing part, with respect to the replaceable unit as a reference.

(10)

An image forming unit including the developing unit according to (8) or (9).

(11)

An image forming apparatus including the image forming unit according to (10).

(12)

The replaceable unit according to (1), further including one or more posts provided on one of the body and the holder, the one or more posts each being different from the first post, in which any of the body and the holder has one or more holes each provided at a position that faces any of the one or more posts, the one or more holes each being different from the first hole, the memory element includes a first terminal and a second terminal both provided between the first post and the one or more posts, a distance from the first terminal to the first post is smaller than a distance from the first terminal to all of the one or more posts, and a distance from the second terminal to the first post is greater than a distance from the second terminal to any or all of the one or more posts.

(13)

The replaceable unit according to (12), in which the body further has a first toner passing hole, the first toner passing hole extending in a direction in which each of the first post and the one or more posts extends and allowing a waste toner contained in the body to pass through the first toner passing hole, the first post is located at a lower position in a vertical direction than the first terminal, any or all of the one or more posts is located at an upper position in the vertical direction than the second terminal, and each of the first terminal and the second terminal has a shape having a dimension in the vertical direction that is greater than a dimension in a direction orthogonal to the vertical direction.0016

(14)

The replaceable unit according to (13), in which the body further has a waste toner container an unused toner container, and a second toner passing hole, the waste toner container being in communication with the first toner passing hole and containing a used toner, the unused toner container containing an unused toner, the second toner passing hole allowing the unused toner to be discharged from the unused toner container, and each of the first terminal and the second terminal has a shape having a dimension in an unused toner passing direction that is greater than a dimension in a direction orthogonal to the unused toner passing direction, the unused toner passing direction being a direction in which the unused toner passes through the second toner passing hole.

In any of the replaceable unit, the developing unit, the image forming unit, and the image forming apparatus according to the respective embodiment of the technology, an attempt to remove the holder from the body for replacement of the memory element leads to any of: deformation of the first head; falling-off of the first head from the first insert; and deformation of the first hole. Therefore, it is easy to determine that the replaceable unit having any of the deformation of the first head; the falling-off of the first head from the first insert; and the deformation of the first hole is a recycled product.

According to any of the replaceable unit, the developing unit, the image forming unit, and the image forming apparatus according to the respective embodiments of the technology, it is possible to make an easy determination as to whether the replaceable unit is a recycled product.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive.

What is claimed is:

1. A replaceable unit comprising:

a body;

a memory element;

a holder having a first hole and holding the memory element to the body;

a first post provided on the body, and including a first insert and a first head, the first insert being inserted into the first hole, the first head being located on opposite side of the first insert to the body and covering a periphery of the first hole of the holder;

one or more posts provided on one of the body and the holder, the one or more posts each being different from the first post, wherein any of the body and the holder has one or more holes each provided at a position that faces any of the one or more posts, the one or more holes each being different from the first hole, the memory element includes a first terminal and a second terminal both provided between the first post and the one or more posts, a distance from the first terminal to the first post s smaller ran a distance from the first terminal to all of the one or more posts, and a distance from the second terminal to the first post is greater than a distance from the second terminal to any or all of the one or more posts, and wherein the body further has a first toner passing hole, the first toner passing hole extending in a direction in which each of the first post and the one or more posts extends and allowing a waste toner contained in the body to pass through the first toner passing hole, the first post is located at a lower position in a vertical direction than the first terminal, any or all of the one or more posts is located at an upper position in the vertical direction than the second terminal, and each of the first terminal and the second terminal has a shape having a dimension in the vertical direction that is greater than a dimension in a direction orthogonal to the vertical direction.

2. The replaceable unit according to claim 1, further comprising a second post provided on the body, and including a second insert and a second head, the second head being located on opposite side of the second insert to the body and protruding by an amount greater than an amount by which the first head of the first post protrudes, wherein the holder further has a second hole, and the second insert is inserted into the second hole.

3. The replaceable unit according to claim 2, wherein a first insertion direction is substantially coincident with a second insertion direction, the first insertion direction being a direction in which the first post is inserted into the first hole, the second insertion direction being a direction in which the second post is inserted into the second hole.

4. The replaceable unit according to claim 1, whether first hole has an inner circumferential surface, and the first insert has an outer circumferential surface that is in contact with the inner circumferential surface of the first hole.

5. The replaceable unit according to claim 4, wherein the inner circumferential surface has a groove, and the groove is filled with the first insert.

6. The replaceable unit according to claim 1, wherein the memory element and the holder are provided separately from each other.

7. The replaceable unit according to claim 1, further comprising a third post provided on one of the body and the holder, wherein the other of the body and the holder has a third hole, the third post is inserted into the third hole, and the third hole extends along a straight line that passes through both the first post and the third hole.

8. A developing unit, comprising the replaceable unit according to claim 1.

9. A developing unit comprising:

the replaceable unit according to claim 2; and an attachment section to which the replaceable unit is to be attached, the attachment section including a first facing part provided at a first position, the first position facing the first post, and a second facing part provided at a second position, the second position facing the second post, and being recessed, compared with the first position of the first facing part, with respect to the replaceable unit as a reference.

10. An image forming unit comprising the developing unit according to claim 8.

11. An image forming apparatus comprising the image forming unit according to claim 10.

12. The replaceable unit according to claim 1, wherein the body further has a waste toner container, an unused toner container, and a second toner passing hole, the waste toner container being in communication with the first toner passing hole and containing a used toner, the unused toner container containing an unused toner, the second toner passing hole allowing the unused toner to be discharged from the unused toner container, and each of the first terminal and the second terminal has a shape having a dimension in an unused toner passing direction that is greater than a dimension in a direction orthogonal to the unused toner passing direction, the unused toner passing direction being a direction in which the unused toner passes through the second toner passing hole.

13. The replaceable unit according to claim 1, further comprising:

a body;

a memory element;

a holder having a first hole and a second hole, and holding the memory element to the body;

a first post provided on the body, and including a first insert and a first head, the first insert being inserted into the first hole, the first head being located on opposite side of the first insert to the body and being welded to the holder and covering a periphery of the first hole of the holder; and a second post provided on the body, and including a second insert and a second head, the second insert being inserted into the second hole, the second head being located on opposite side of the second insert to the body and protruding by an amount greater than an amount by which the first head of the first post protrudes.

14. The replaceable unit according to claim 13, wherein the body has a developer containing chamber that contains a developer, and the second post is located at a first position when the developer contained in the developer containing chamber has a first color, and is located at a second position that is different from the first position when the developer contained in the developer containing chamber has a second color.

* * * * *